US005921582A

United States Patent [19]

Gusack

[11] Patent Number: 5,921,582

[45] Date of Patent: Jul. 13, 1999

[54] INDEXING SYSTEM, RECORD STRUCTURE, AND LINKING METHODOLOGY FOR PAPER-BASED AND ELECTRONIC-BASED INFORMATIONAL ASSEMBLIES

[76] Inventor: Mark David Gusack, 9800 NW 47 Dr., Coral Springs, Fla. 33076-2602

[21] Appl. No.: 09/079,681

[22] Filed: May 15, 1998

Related U.S. Application Data

[60] Provisional application No. 60/048,024, May 28, 1997.

[51] Int. Cl.[6] ..... B42D 15/00

[52] U.S. Cl. ..... 283/67; 283/36

[58] Field of Search ..... 283/67, 70, 36–42, 283/74, 72, 117

[56] References Cited

U.S. PATENT DOCUMENTS

| | | | |
|---|---|---|---|
| 74,299 | 2/1868 | Campell et al. | 283/36 |
| 191,517 | 6/1877 | Coombs | 283/2 |
| 191,885 | 6/1877 | Roberts | 283/39 |
| 199,796 | 1/1878 | Collins | 283/2 |
| 224,335 | 2/1880 | Horton | 283/2 |
| 265,717 | 10/1882 | Tebbetts | 283/41 |
| 285,531 | 9/1883 | Wagstaff | 283/41 |
| 347,305 | 8/1886 | Schlicht | 283/41 |
| 370,280 | 9/1887 | Perley | 283/36 |
| 407,363 | 7/1889 | Mathews | 283/2 |
| 536,646 | 4/1895 | McDowell | 283/42 |
| 564,117 | 7/1896 | Stamford | 209/613 |
| 587,167 | 7/1897 | White | 283/36 |
| 663,639 | 12/1900 | Rand | 283/42 |
| 686,095 | 11/1901 | Liddell | 283/2 |
| 695,226 | 3/1902 | McMillen | 283/41 |
| 721,342 | 2/1903 | Thomas | 283/41 |
| 766,763 | 8/1904 | Judge | 283/2 |
| 790,002 | 5/1905 | Rand | 283/39 |
| 851,439 | 4/1907 | Rice | 283/3 |
| 983,072 | 1/1911 | Maher | 283/41 |
| 1,015,658 | 1/1912 | Ward | 283/41 |
| 1,026,804 | 5/1912 | Hare | 283/40 |

(List continued on next page.)

OTHER PUBLICATIONS

Huffman, Edna K. 1994 Health Information Management pp. 276–289.

Solomon, et al. 1983 Accounting Principles pp. 51–53.

*Primary Examiner*—Willmon Fridie, Jr.

[57] ABSTRACT

An indexing system and linking method for an assembly of paper-based informational items ordered by an hierarchy of informational divisions represented by a plurality of tabbed section dividers (601) and tabbed file folders (901) with pre-assigned section indicia printed on their markable surfaces. Said sections contain a plurality of form pages (701), and document pages (1001) with pre-assigned section and page indicia printed on their markable surfaces. Said pages contain a plurality of tabular design objects (201, 301, and 401) printed on their markable surfaces . Said tabular objects contain a plurality of records that contain a plurality of data fields for entering informational items on said markable surface. Each said record is pre-assigned a indicum printed in another entry field. The concatenation of each record indicum with the section and page indicia printed on the same markable surface creates a unique identifier and locator for every informational record in the assembly of informational items. Each record in each tabular design object contains three entry fields corresponding to the section, page, and record indicia and provide a method of linking one or more informational records to each other by entering one or more of said section, page, and record indica of the link-to record or records into the section, page, and record entry fields of the link-from record. Said informational assembly may be stored in and moved between a plurality informational division holders represented by a plurality of uniquely identified releasably bound journals (501), file boxes (801), and non-releasable binders. The divisional structure provides a means for organizing an assembly of informational items into an hierarchy of tables that may be created, ordered, and stored on a plurality of electronic-based media into which informational items may be entered for manipulation by computer programs, display on video monitors, and output to a variety of physical media providing for complete integration with the above described paper-based system.

18 Claims, 26 Drawing Sheets

U.S. PATENT DOCUMENTS

| | | | |
|---|---|---|---|
| 1,084,174 | 1/1914 | Thomas | 283/36 |
| 1,183,779 | 5/1916 | Thacker | 283/36 |
| 1,234,502 | 7/1917 | Smith | 283/36 |
| 1,284,981 | 11/1918 | Ball | 283/36 |
| 1,299,887 | 4/1919 | White | 283/36 |
| 1,300,662 | 4/1919 | Showalter | 283/36 |
| 1,322,275 | 11/1919 | White | 283/36 |
| 1,519,643 | 12/1924 | Arsdale | 283/3 |
| 1,698,461 | 1/1929 | Thebaud | 283/42 |
| 2,068,262 | 1/1937 | Brown | 209/612 |
| 2,151,929 | 3/1939 | Mercau | 209/613 |
| 2,261,861 | 11/1941 | Smith | 283/2 |
| 2,579,757 | 12/1951 | Riggs | 209/612 |
| 2,690,751 | 10/1954 | Feiertag | 209/612 |
| 3,688,900 | 9/1972 | Wanous | 209/612 |
| 3,805,426 | 4/1974 | Cunningham | 283/39 |
| 3,908,829 | 9/1975 | Muller et al. | 203/612 |
| 3,958,816 | 5/1976 | Remmey, III | 283/38 |
| 4,050,719 | 9/1977 | Cunningham | 283/36 |
| 4,175,663 | 11/1979 | Halm | 209/612 |
| 4,178,019 | 12/1979 | Gedzelman | 283/2 |
| 4,218,077 | 8/1980 | Ember | 283/2 |
| 4,319,771 | 3/1982 | Esquivel Yglesias | 283/2 |
| 4,334,771 | 6/1982 | Ryan, Jr. | 355/40 |
| 4,355,824 | 10/1982 | Weber et al. | 283/40 |
| 4,445,711 | 5/1984 | Cunningham | 283/39 |
| 4,451,067 | 5/1984 | Williams | 283/2 |
| 4,472,893 | 9/1984 | Curti | 283/2 |
| 4,489,958 | 12/1984 | Martin | 283/3 |
| 4,575,126 | 3/1986 | Grubbs | 283/38 |
| 4,585,253 | 4/1986 | Beisswanger | 283/39 |
| 4,596,407 | 6/1986 | Suska | 281/15 R |
| 4,652,014 | 3/1987 | Maher | 283/36 |
| 4,669,754 | 6/1987 | Lalonde | 283/67 |
| 4,696,491 | 9/1987 | Stenger | 283/36 |
| 4,793,634 | 12/1988 | Alloggiamento | 283/2 |
| 4,794,711 | 1/1989 | Christensen | 283/2 |
| 4,832,374 | 5/1989 | Prest, Jr. | 283/36 |
| 4,927,178 | 5/1990 | Schechter | 283/38 |
| 4,947,564 | 8/1990 | Reece et al. | 283/2 |
| 4,973,086 | 11/1990 | Donnelly et al. | 283/39 |
| 4,993,749 | 2/1991 | Volk | 281/38 |
| 5,033,899 | 7/1991 | Pitts et al. | 283/36 X |
| 5,123,676 | 6/1992 | Donnelly et al. | 283/37 |
| 5,197,764 | 3/1993 | Hicinbothem et al. | 283/36 |
| 5,214,869 | 6/1993 | Wilen | 283/2 |
| 5,333,908 | 8/1994 | Dorney et al. | 283/38 |
| 5,358,280 | 10/1994 | Scales | 283/36 |
| 5,503,487 | 4/1996 | Ong | 402/79 |
| 5,590,911 | 1/1997 | Wilson | 283/36 |
| 5,641,182 | 6/1997 | Schwndt | 283/38 |
| 5,794,238 | 8/1998 | Gural | 283/67 |
| 5,810,395 | 9/1998 | Morgan | 283/67 X |

| REC # | LAST NAME | FIRST NAME | DATE OF BIRTH | SSN |
|---|---|---|---|---|
| 1 | Stevenson | Justin | 7/12/56 | 123-45-6789 |
| 2 | Tanner | Markus | 4/12/35 | 987-65-4321 |
| 3 | Ustanov | Robert | 12/1/89 | 101-01-0101 |
| 4 | Zung | Richard | 8/19/67 | 305-12-8439 |

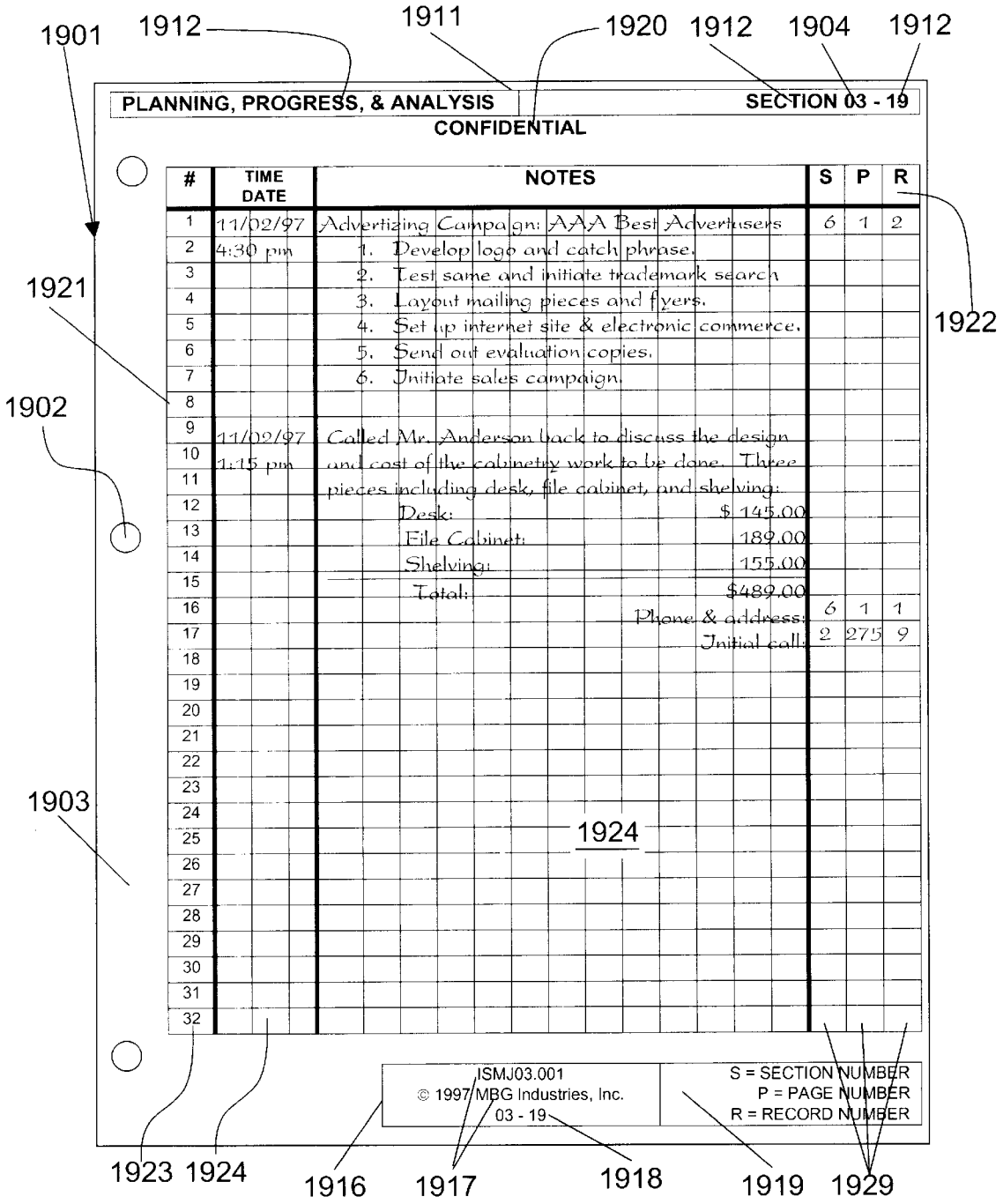

| # | TIME DATE | NOTES | S | P | R |
|---|---|---|---|---|---|
| 1 | 11/02/97 | Advertizing Campaign: AAA Best Advertisers | 6 | 1 | 2 |
| 2 | 4:30 pm | 1. Develop logo and catch phrase. | | | |
| 3 | | 2. Test same and initiate trademark search | | | |
| 4 | | 3. Layout mailing pieces and flyers. | | | |
| 5 | | 4. Set up internet site & electronic commerce. | | | |
| 6 | | 5. Send out evaluation copies. | | | |
| 7 | | 6. Initiate sales campaign. | | | |
| 8 | | | | | |
| 9 | 11/02/97 | Called Mr. Anderson back to discuss the design | | | |
| 10 | 1:15 pm | and cost of the cabinetry work to be done. Three | | | |
| 11 | | pieces including desk, file cabinet, and shelving: | | | |
| 12 | | Desk: $ 145.00 | | | |
| 13 | | File Cabinet: 189.00 | | | |
| 14 | | Shelving: 155.00 | | | |
| 15 | | Total: $489.00 | | | |
| 16 | | Phone & address: | 6 | 1 | 1 |
| 17 | | Initial call: | 2 | 275 | 9 |
| 18 | | | | | |
| 19 | | | | | |
| 20 | | | | | |
| 21 | | | | | |
| 22 | | | | | |
| 23 | | | | | |
| 24 | | | | | |
| 25 | | | | | |
| 26 | | | | | |
| 27 | | | | | |
| 28 | | | | | |
| 29 | | | | | |
| 30 | | | | | |
| 31 | | | | | |
| 32 | | | | | |

FIG. 19

2402 2403 2404 2401a 2405 2406 2407 2408

MASTER RECORD INDEXING TABLE
SORTED NUMERICALLY ON S', P', AND R' FIELD INDEX

| S' | P' | R' | RECORD ENTRY DESCRIPTION | S | P | R |
|---|---|---|---|---|---|---|
| 2 | 275 | 9 | Anderson, Howard – call from | 3 | 19 | 10 |
| 2 | 275 | 22 | AAA Best Advertising – Mike Arnall - call from | 2 | 275 | 26 |
| 2 | 275 | 26 | AAA Best Advertising – Continuation Note | 3 | 19 | 1 |
| 3 | 19 | 1 | Advertising Campaign AAA Best Advertisers | 6 | 1 | 2 |
| 3 | 19 | 10 | Anderson, Howard - Cabinetry Design and Cost | 3 | 19 | 17 |
| 3 | 19 | 17 | Anderson, Howard - Cabinetry Design and Cost | 6 | 1 | 1 |
| 3 | 19 | 18 | Anderson, Howard - Cabinetry Design and Cost | 2 | 275 | 9 |
| 6 | 1 | 1 | Anderson, Howard – Phone Address | 2 | 275 | 9 |
| 6 | 1 | 2 | AAA Best Advertising - Arnall, Mike – Phone Address | 2 | 275 | 22 |

2409

2402 2403 2404 2401b 2405 2406 2407 2408

MASTER RECORD INDEXING TABLE
SORTED ALPHABETICALLY ON RECORD ENTRY DESCRIPTION FIELD INDEX

| S' | P' | R' | RECORD ENTRY DESCRIPTION | S | P | R |
|---|---|---|---|---|---|---|
| 6 | 1 | 2 | AAA Best Advertising - Arnall, Mike – Phone Address | 2 | 275 | 22 |
| 2 | 275 | 26 | AAA Best Advertising – Continuation Note | 3 | 19 | 1 |
| 2 | 275 | 22 | AAA Best Advertising – Mike Arnall - call from | 2 | 275 | 26 |
| 3 | 19 | 1 | Advertising Campaign AAA Best Advertisers | 6 | 1 | 2 |
| 3 | 19 | 10 | Anderson, Howard - Cabinetry Design and Cost | 3 | 19 | 17 |
| 3 | 19 | 17 | Anderson, Howard - Cabinetry Design and Cost | 6 | 1 | 1 |
| 3 | 19 | 18 | Anderson, Howard - Cabinetry Design and Cost | 2 | 275 | 9 |
| 2 | 275 | 9 | Anderson, Howard – call from | 3 | 19 | 10 |
| 6 | 1 | 1 | Anderson, Howard – Phone Address | 2 | 275 | 9 |

FIG. 24

2502 2505 2501 2506 2507

2509

SECTION TABLE (SRO)

| S' | SECTION NAME | FP | PC |
|---|---|---|---|
| 1 | MONTHLY SCHEDULER | 2 | 24 |
| 2 | DAILY SCHEDULER | 1 | 365 |
| 3 | PLANNING, PROGRESS, & ANALYSIS | 1 | 100 |
| 4 | RAPID PLANNING TABLE | 1 | 52 |
| 5 | INCIDENT INVESTIGATION & ANALYSIS | 2 | 52 |
| 6 | PHONE & ADDRESS | 1 | 26 |
| 7 | BUDGET & EXPENSE | 1 | 12 |

2512 2513 2511 2515 2516 2517

PAGE REGISTRATION TABLE

| S' | F' | PAGE NAME | VERSION | PT |
|---|---|---|---|---|
| 1 | 1 | MONTHLY SCHEDULER | ISMJ01.001 | 1 |
| 1 | 2 | MONTHLY PLANNER | ISMJ01.001 | 1 |
| 2 | 1 | DAILY SCHEDULER | ISMJ02.001 | 2 |
| 3 | 1 | PLANNING & PROGRESS | ISMJ03.001 | 1 |
| 4 | 1 | RAPID PLANNING | ISMJ04.001 | 3 |
| 5 | 1 | INCIDENT INVESTIGATION | ISMJ05.001 | 1 |
| 5 | 2 | CONTINUATION NOTES | ISMJ05.001 | 1 |
| 6 | 1 | PHONE & ADDRESS | ISMJ06.001 | 1 |
| 7 | 1 | BUDGET & EXPENSE | ISMJ07.001 | 1 |

2519

2522 2523 2524 2521 2525 2526 2527

OBJECT REGISTRATION TABLE

| S' | F' | T' | TABLE NAME | TR | RD |
|---|---|---|---|---|---|
| 1 | 1 | 1 | MONTHLY CALENDAR MCO | 6 | 6 |
| 1 | 2 | 1 | PLANNING TRO | 32 | 32 |
| 2 | 1 | 1 | SCHEDULING TRO | 25 | 25 |
| 2 | 1 | 2 | CONTINUATION NOTES TRO | 11 | 35 |
| 3 | 1 | 1 | PLANNING & PROGRESS TRO | 36 | 36 |
| 4 | 1 | 1 | PROGRAM INSTRUCTIONS TRO | 20 | 20 |
| 4 | 1 | 2 | CONTINUATION NOTES TRO | 10 | 30 |
| 4 | 1 | 3 | RESPONSIBILITY TRO | 10 | J |
| 5 | 1 | 1 | INCIDENT MRO | 5 | 5 |
| 5 | 2 | 1 | CONTINUATION NOTES TRO | 40 | 40 |
| 6 | 1 | 1 | PHONE & ADDRESS MRO | 4 | 4 |
| 7 | 1 | 1 | BUDGET & EXPENSE MRO | 31 | 31 |

FIG. 25

2502 2505 2501

SECTION TABLE (SRO)

| S' | SECTION NAME |
|---|---|
| 1 | MONTHLY SCHEDULER |
| 2 | DAILY SCHEDULER |
| 3 | PLANNING, PROGRESS, & ANALYSIS |
| 4 | RAPID PLANNING TABLE |
| 5 | INCIDENT INVESTIGATION & ANALYSIS |
| 6 | PHONE & ADDRESS |
| 7 | BUDGET & EXPENSE |

2609

2602 2603 2601 2605

DAILY SCHEDULER PAGE-RECORD TABLE (PRO)

| S' | P' | DATEFIELD |
|---|---|---|
| 2 | 274 | 01 OCTOBER 1997 |
| 2 | 275 | 02 OCTOBER 1997 |
| 2 | 276 | 03 OCTOBER 1997 |
| 2 | 277 | 04 OCTOBER 1997 |
| 2 | 278 | 05 OCTOBER 1997 |

2619

2612 2613 2614 2615a 2611 2616 2617 2618

SCHEDULING DATA TABLE (TRO)

| S' | P' | R' | TIME | APPOINTMENT | DESCRIPTION | PHONE | S | P | R |
|---|---|---|---|---|---|---|---|---|---|
| 2 | 275 | 19 | 3:00 | 2615b | 2615c | 2615d | | | |
| 2 | 275 | 20 | | | | | | | |
| 2 | 275 | 21 | 4:00 | | | | | | |
| 2 | 275 | 22 | 4:30 | Call From | Mike – AAA Best Advertising | See Note | 2 | 275 | 26 |
| 2 | 275 | 23 | 5:00 | | | | | | |

2629

2622 2623 2624 2625a 2621 2626 2627 2628

CONTINUTION DATA TABLE (TRO)

| S' | P' | R' | TIME | NOTE TEXT | S | P | R |
|---|---|---|---|---|---|---|---|
| 2 | 275 | 26 | | Mike gave his background in advertising and what his | 3 | 19 | 1 |
| 2 | 275 | 27 | | Company can do for me. We discussed the plan 2625b | | | |
| 2 | 275 | 28 | | Initiation of an advertising campaign – see link | | | |
| 2 | 275 | 29 | | | | | |

2639

2632 2633 2634 2635a 2631 2636 2637 2638

PLANNING & PROGRESS DATA TABLE (TRO)

| S' | P' | R' | T/D | NOTES | S | P | R |
|---|---|---|---|---|---|---|---|
| 3 | 19 | 1 | 11/02/97 | Advertizing Campaign AAA Best Advertisers | 6 | 1 | 2 |
| 3 | 19 | 2 | 4:30PM | 1. Develop logo and catch phrase. | | | |
| 3 | 19 | 3 | | 2. Test same and initiate trademark search. | | | |
| 3 | 19 | 4 | | 3. Layout mailing pieces and flyers. | | | |
| 3 | 19 | 5 | | 4. Set up internet site and electronic comerce. | | | |
| 3 | 19 | 6 | | 5. Send out evaluation copies. 2635b | | | |
| 3 | 19 | 7 | | 6. Initiate sales campaign. | | | |

FIG. 26

INDEXING SYSTEM, RECORD STRUCTURE, AND LINKING METHODOLOGY FOR PAPER-BASED AND ELECTRONIC-BASED INFORMATIONAL ASSEMBLIES

Applicant claims priority of Provisional application Ser. No. 60/048,024 filed on May 28, 1997.

BACKGROUND

1. Field of Invention

This invention relates to indexing and linking information, specifically to both paper-based and electronic-based assemblies of information stored in forms and documents with additional application to integrating paper-based and electronic-based data systems.

2. Description of Prior Art

Historically, forms and documents have been widely distributed throughout society as paper-based and electronic-based data files, books, journals, catalogs, reports, newspapers, flyers, letters, memoranda, applications, tabular data, sounds, images, and other types of materials. An assembly of these materials defines a vast informational and object database, herein referred to as an assembly of informational items.

An example of an assembly of informational items is a collection of personal notes and professional journal articles a doctor, scientist, or lawyer maintains. The notes might be stored in a loose-leaf notebook and each journal placed in chronological order on shelves. Alternately, to facilitate retrieval, individual articles might be removed from the journals, indexed, and stored in alphabetical order or by category in a filing cabinet. Many advantages are gained by assembling informational items so that they may be efficiently stored, retrieved, and analyzed to create knowledge.

Today, advances in computer technology have provided a plurality of electronic media such as ferromagnetic rotating memory devices, magneto-optical disks, optical disks, and static random access memory herein below referred to as electronic-based media. The availability of said media provides the means to create, store, print, and disseminate increasingly large amounts of data at increasing higher rates. The resulting volume of publications has overwhelmed the capacity of present filing and indexing systems making it difficult to retrieve, assemble and analyze information to create knowledge.

In addition to the flood of published information, there are growing requirements in industry and commerce for individuals to schedule activities, manage resources, and document personal observations or actions in forms-based journal systems. Risk management and quality assurance practices make it necessary to apply published information to the analysis of this journal-based data to solve problems and implement solutions. As will be shown below, there is no system or methodology for indexing and linking various parts of journal-based and filed information into a comprehensive and useful assembly that facilitates analysis and creation of knowledge.

A review of prior art reveals a rich history going back to at least 1868. Numerous attempts have been made to index an assembly of informational items of one type or another with the purpose of making the search and retrieval of information easier and quicker. Significant examples of prior art include the introduction of tab dividers in 1877 by Roberts (U.S. Pat. No. 191,885) and more recently, pressure sensitive adhesive backed labels introduced by Cunningham in 1974 (U.S. Pat. No. 3,805,426). There have been various inventions to combine calendars and a memorandum book such as that of Collins in 1879 (U.S. Pat. No. 199,796R) and that of Gedzelman In 1979 (U.S. Pat. No. 4,178,019). Attempts were made to handle overflow of entry data or group together discontinuous entries by Schlicht in 1886 (U.S. Pat. No. 347,305) and White in 1897 (U.S. Pat. No. 587,167). In 1896 Stamford (U.S. Pat. No. 564,117) proposed the use of mechanical devices and pre-punched cards to index and retrieve paper-based information.

A review of the literature pertaining to filing large amounts of paper-based information reveals assigning partitioned sets of short numeric indicia to file folders for ease of manual retrieval. References to pre-assignment of indicia and provision for cross-linking was not found. A reference for this information is Health Information Management by Edna K. Huffman, RRA, Physician's Record Company, Berwyn, Ill., 10th Edition, 1994 ISBN 0-917036-17-4; in particular chapter 8: Filing Methods, Storage, and Retention pages 276–289.

A review of accounting practices reveals the routine use of a posting reference field similar to Smith's invention cited herein above, which allow for simple, single level cross-referencing between General Journal entries and General Ledger accounts. The system requires using dates to make the link specific and does not provide the means to expand the assembly of informational items beyond the accounting data. A reference for this information is Accounting Principles by Solomon, Lanny M., et al., Harper & Row, Publishers, 1983 ISBN 0-06-046348-1; in particular chapter 2: Processing Accounting Information pages 51–53.

Every solution put forth by prior art ignores the special requirements of paper-based forms, two-dimensional displays, record level indexing, and informational linking needed to provide a rich and flexible methodology for creating knowledge from an assembly of informational items while providing an efficient means of retrieving important data. As presently designed, two-dimensional paper-based forms and documents do not provide the capability to enter variable amounts of symbolic, graphical, textual or numeric data without requiring that another entry field or form be overwritten, an odd piece of paper be inserted, or the overflow data be stored elsewhere threatening the integrity of that entry or other entries. As presently designed, paper-based systems do not provide a way to easily integrate new or redesigned forms, documents, and tables of information without disrupting the organizational integrity, indexing system, and links. As presently designed, forms and document systems do not provide an efficient and effective way to link-together entry records stored in more than one part of the assembly of informational items in the absence of electronic-based data systems. When created and stored on electronic media, these links cannot be recapitulated in paper-based reports below the tabular level. These deficiencies prevent the creation of useful compound documents which reflect the complexity and interrelationships between a plurality of informational items and thereby limits the creation of knowledge and ease of retrieval of important information.

For the foregoing reasons, there is a need for an improved indexing system that allows for the use of a sophisticated linking methodology which provides a simple and efficient means for interrelating multiple entries located at different points in an assembly of information. This improved indexing system is also needed to provide a highly organized record structure that allows for any degree of integration of paper-based systems with electronic-based informational assemblies.

SUMMARY OF THE INVENTION

Accordingly, it is an object of this invention to provide a unique indexing system, constructed from an hierarchy of pre-assigned indicia that organize textual, graphic, and symbolic material into structured records stored on both paper-based and electronic-based media that comprises an assembly of informational items consisting of releasably bound journals, physical files, non-releasably bound documents, and electronic-based files which possess a higher degree of order, integrity, continuity, and user convenience than indexing systems of prior art.

A further object of this invention is to provide an indexing system for an assembly of informational items that enables quick and easy revisions to a plurality of entries in the assembly while maintaining the originally designated high degree of order.

A still further object of this invention is to provide an indexing system for an assembly of informational items that enables the quick and easy addition of a plurality of new material to the information assembly while maintaining the originally designated high degree of order.

A still further object of this invention is to provide an indexing system for an assembly of informational items that enables the quick and easy addition of a plurality of new form and document designs to present an informational assembly while maintaining the originally designated high degree of order.

A still further object of this invention is to provide an indexing system for an assembly of informational items that enables the quick and easy removal and archiving of a plurality of old material from the information assembly while maintaining the originally designated high degree of order.

A still further object of this invention is to provide an indexing system for an assembly of informational items wherein all or part of the materials placed in a plurality of releasably bound journals may be removed and placed in a physical file containing a plurality of entries while maintaining the originally designated high degree of order.

A still further object of this invention is to provide an indexing system for an assembly of informational items wherein all or part of a plurality of materials placed in a physical file may be removed and placed in a plurality of releasably bound journals containing a plurality of entries while maintaining the originally designated high degree of order.

A still further object of this invention is to provide an indexing system for an assembly of informational items wherein all or part of the materials placed in a plurality of files and a plurality of journals may be removed and placed together in non-releasable binders while maintaining the originally designated high degree of order.

A still further object of this invention is to devise a storage and display structure for an assembly of informational items which facilitates the use of the indexing system and provides a means for executing linking methodologies to join said indexed information together to create complex compound structures.

A still further object of this invention is to provide a linking method whereby a plurality of non-sequential and physically separate textual, graphic, and symbolic entries in an assembly of informational items may be joined together in a variety of indexing lists so as to increase the degree of order in the assembly so that they may be more quickly and easily found.

A still further object of this invention is to provide a linking method whereby a plurality of non-sequential textual, graphic, and symbolic entries in an assembly of informational items may be joined together so that they may be quickly and easily retrieved as a group for analysis while maintaining the originally designated high degree of order.

A still further object of this invention is to provide a linking method whereby a plurality of non-sequential textual, graphic, and symbolic entries in an assembly of informational items may be joined together so that they may be ordered by date and time while maintaining the originally designated high degree of order.

A still further object of this invention is to provide a linking method whereby a plurality of non-sequential textual, graphic, and symbolic entries in an assembly of items may be joined together so that the user may extend a single entry of information across a plurality of noncontiguous entry records, pages, and/or sections while maintaining the original high degree of order.

A still further object of this invention is to provide an indexing system and linking method whereby an assembly of items may be stored, organized, retrieved, analyzed, and displayed simultaneously on a plurality of paper-based and electronic-based media while maintaining the original high degree of order.

A still further object of this invention is to provide an indexing system and linking method whereby an assembly of items may be copied and/or moved between a plurality of paper-based and electronic-based media while maintaining the original high degree of order.

BRIEF DESCRIPTION OF DRAWINGS

Various other objects, features, and attendant advantages of the present invention will be more fully appreciated as the same becomes better understood when considered in conjunction with the accompanying drawings.

Structure of the Journal System

Figure 5:
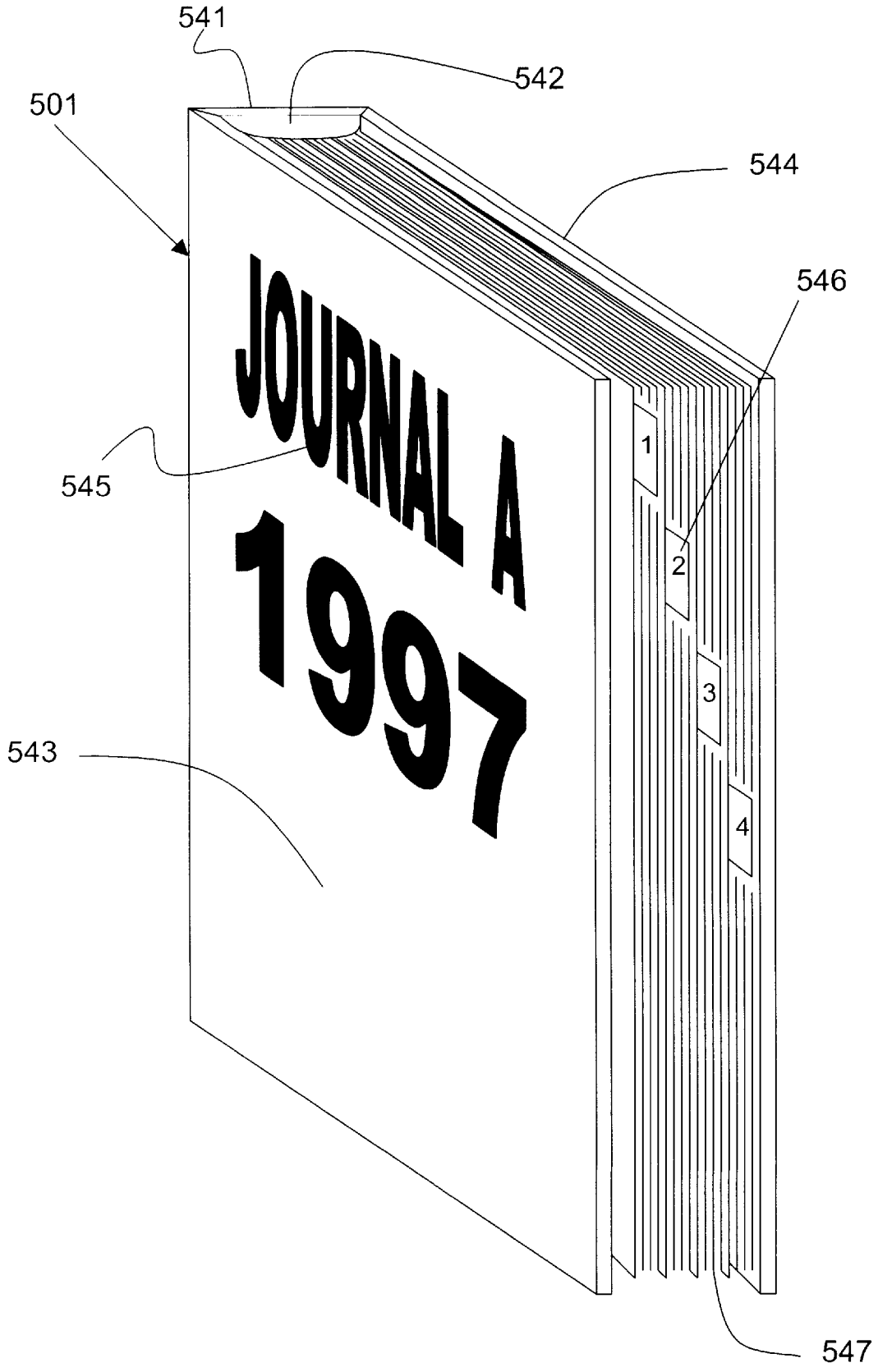

FIG. 5 is a three-dimensional orthogonal view of a uniquely identified releasably bound journal showing front and back covers with ring holder key and a plurality of pages separated and ordered by a plurality of tabbed section dividers in accordance with an embodiment of the present invention.

Figure 6:
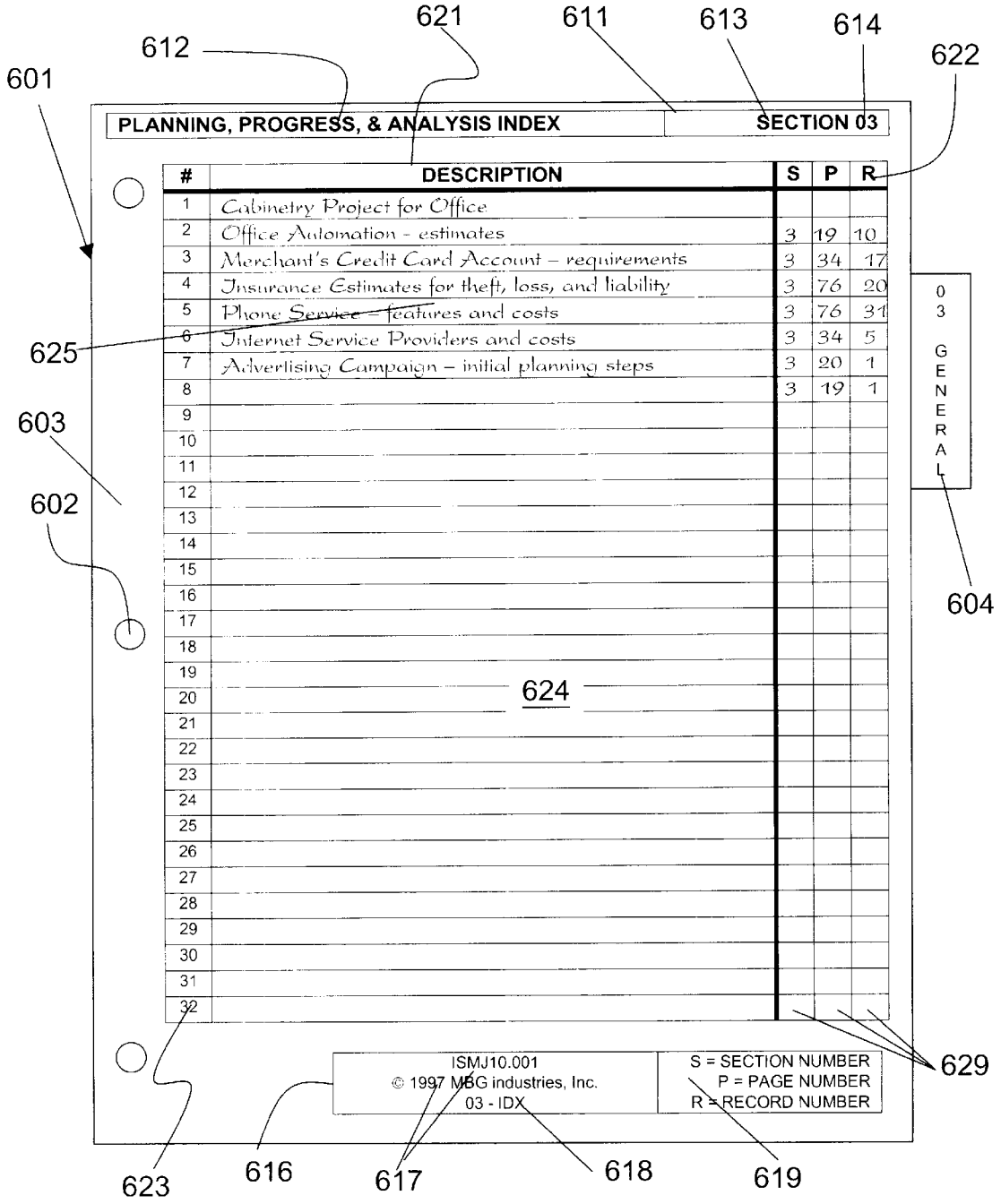

FIG. 6 is a two-dimensional view of one side of a tabbed section divider removed from the journal shown in FIG. 5 for use as an informational division, section locator, and tabular index in accordance with an embodiment of the present invention.

Figure 2:
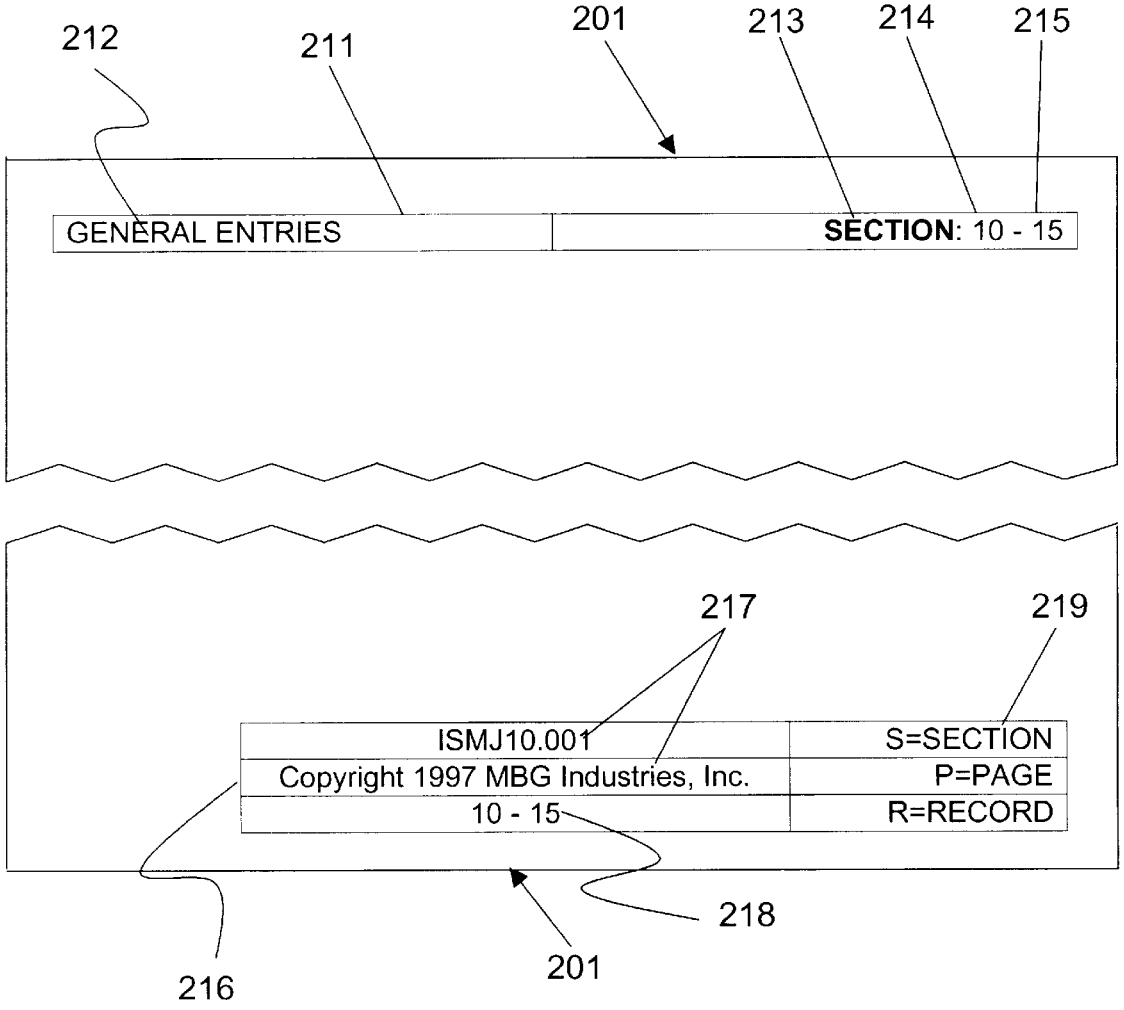
FIG. 2 PRIOR ART
FIG. 2 is a partial view of the top and bottom of a page illustrating catalog card type header and footer records positioned thereon with completed entry fields and field labels in accordance with the prior art.
Figure 3:
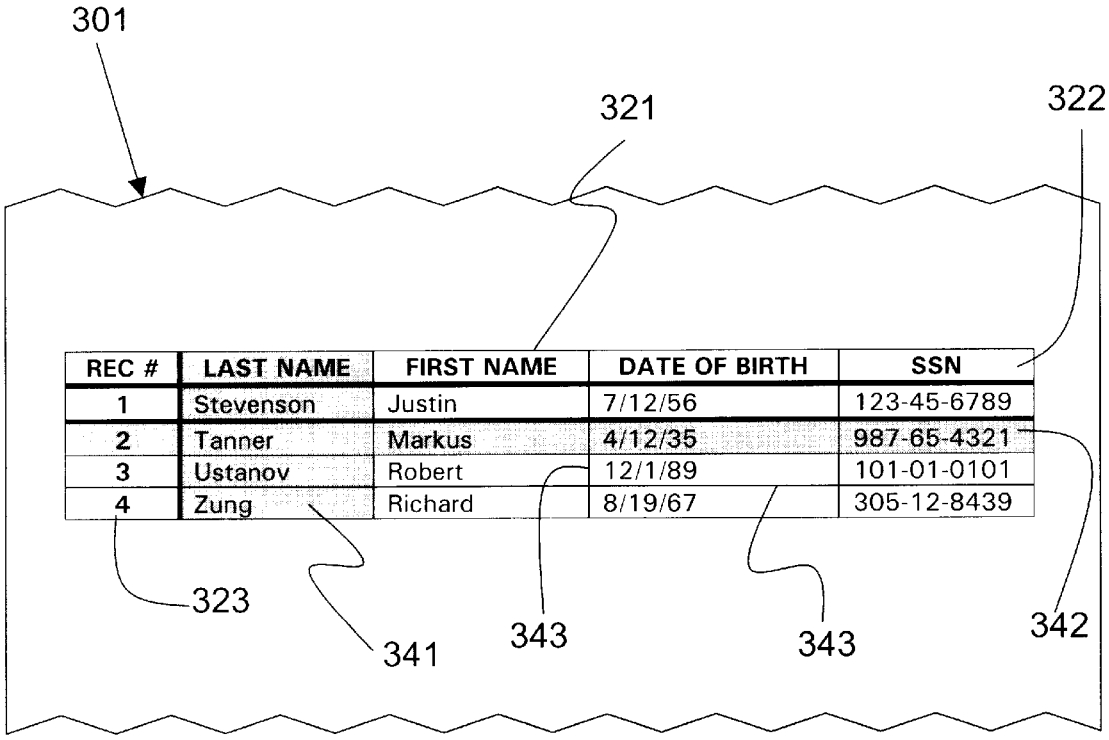
FIG. 3 PRIOR ART
FIG. 3 is a partial view of a page illustrating a centrally located table with five rows, five columns, and table heading labels in accordance with the prior art.
Figure 7:
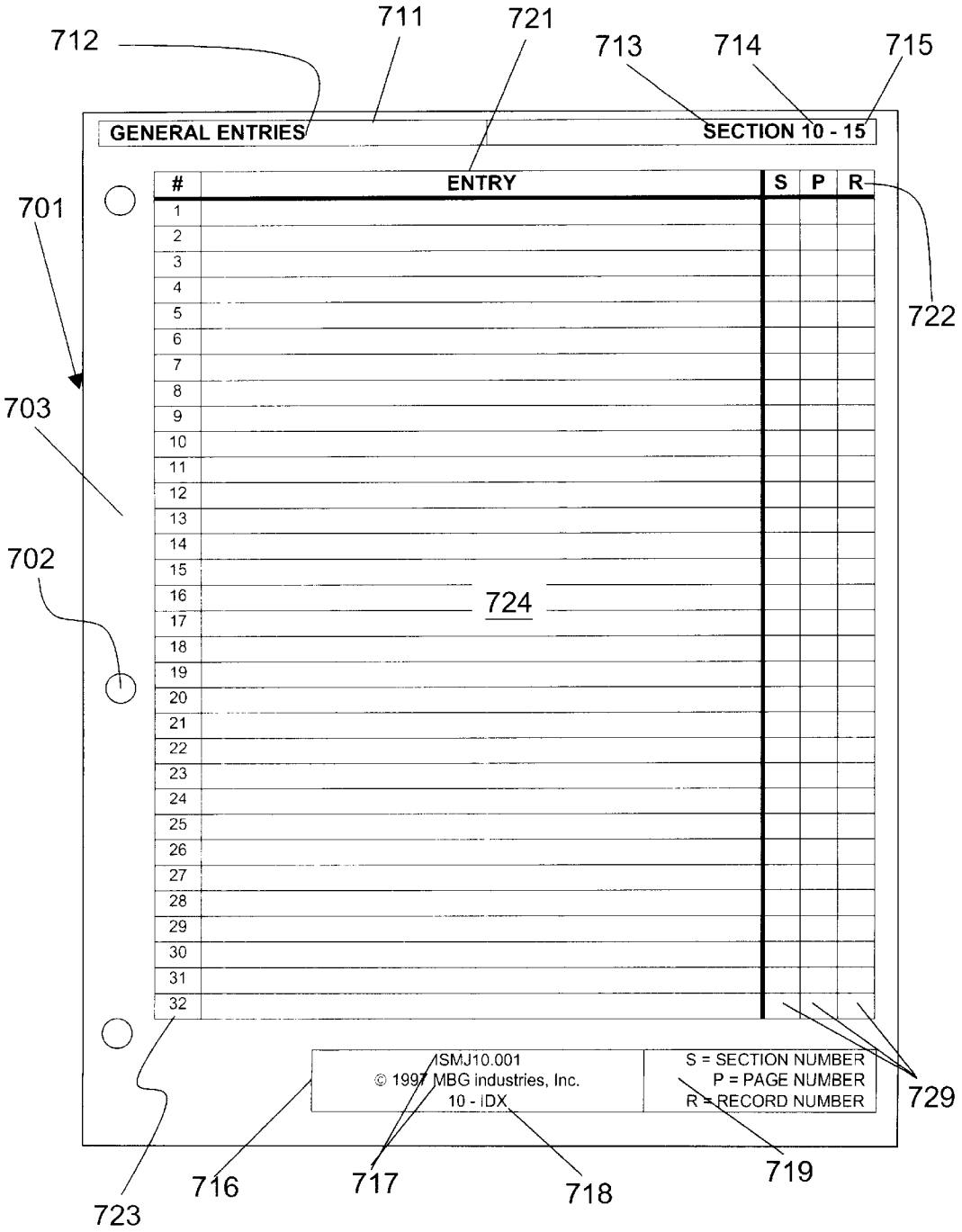

FIG. 7 is a two-dimensional view of one side of a generalized form illustrating a combination of design objects described in FIGS. 2 and 3 in accordance with an embodiment of the present invention.

Structure of the Document File System

Figure 8:
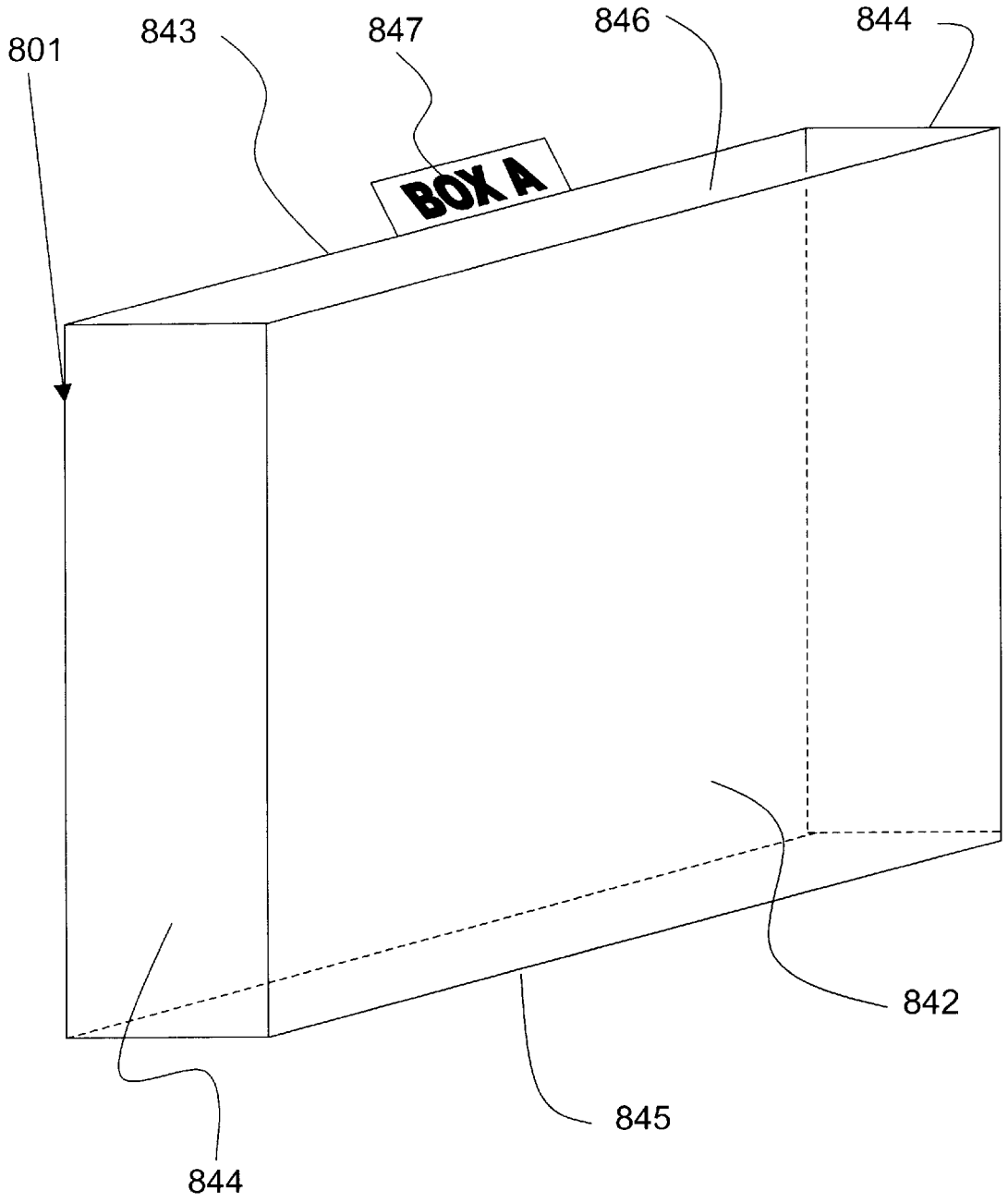

FIG. 8 is a three-dimensional orthogonal view of a uniquely identified file box showing front, back, sides, bottom and an opening at the top into which a plurality of pages separated and ordered by a plurality of tabbed section file folders can be placed in accordance with an embodiment of the present invention.

Figure 9:
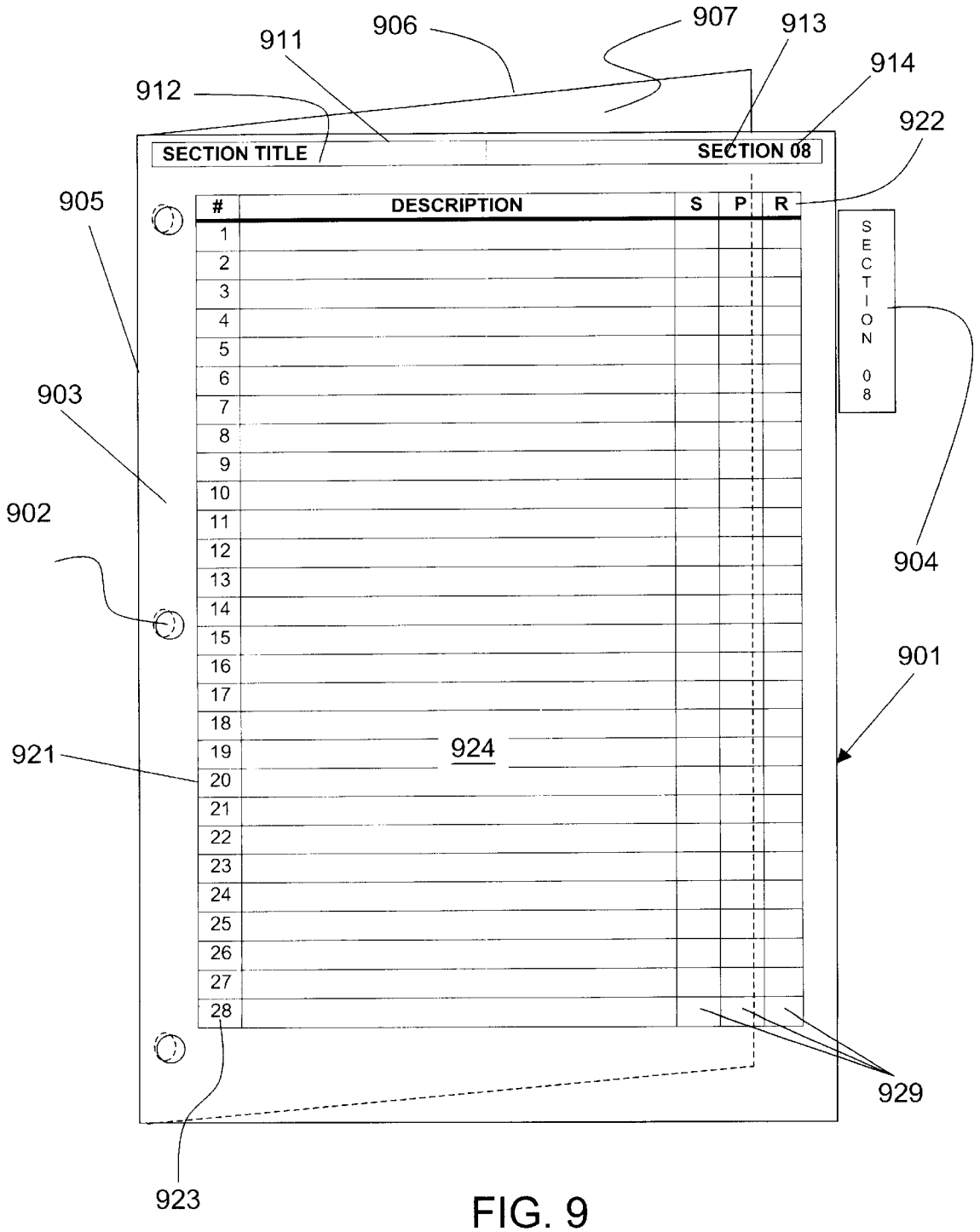

FIG. 9 is a three-dimensional orthogonal view of a partially opened tabbed section file folder removed from the file box shown in FIG. 8 for use as an informational division, section holder, and tabular index in accordance with an embodiment of the present invention.

Figure 10:
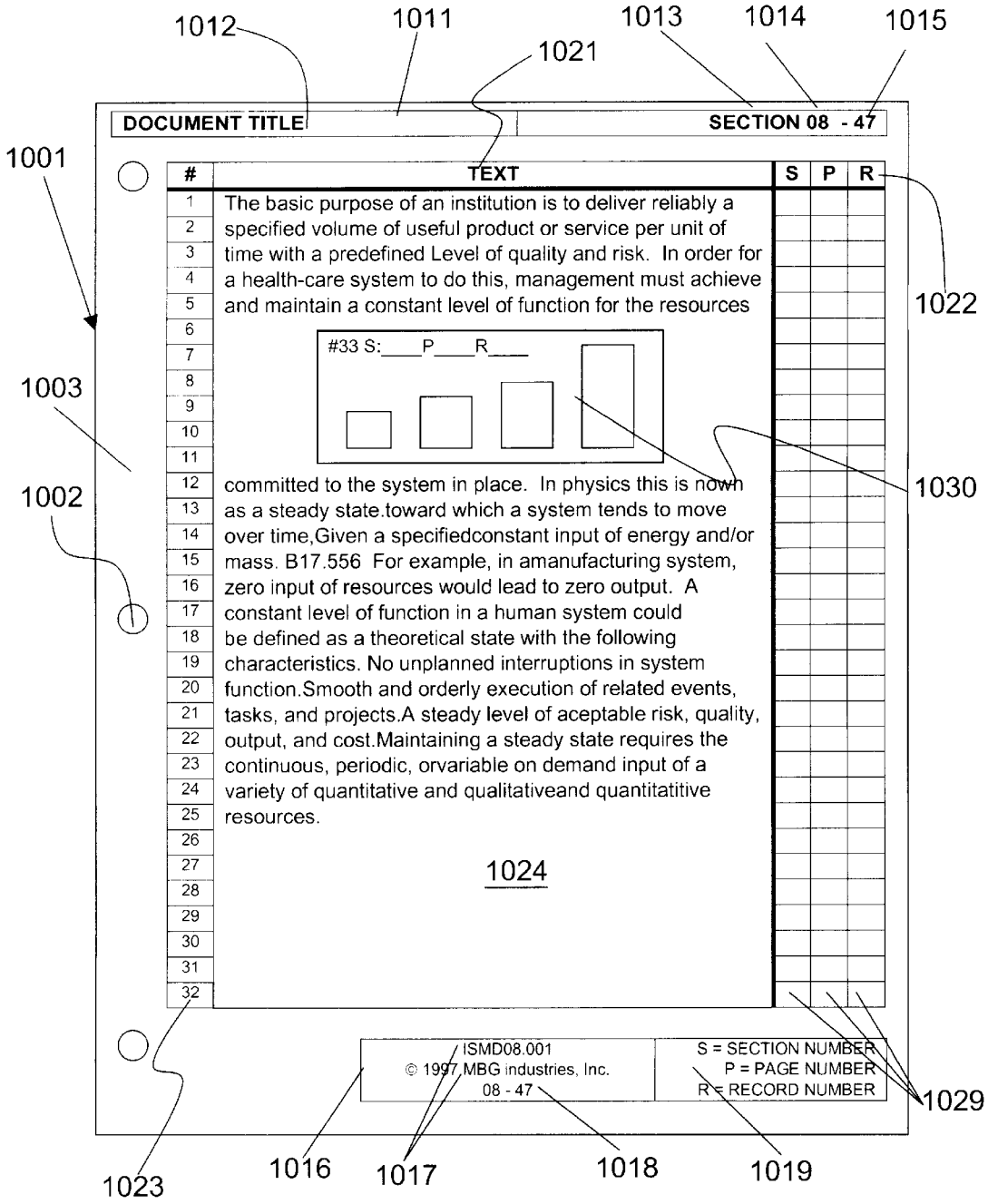

FIG. 10 is a two-dimensional view of one side of a generalized document illustrating a combination of design objects described in FIGS. 2 and 3 in accordance with an embodiment of the present invention.

Figure 11:
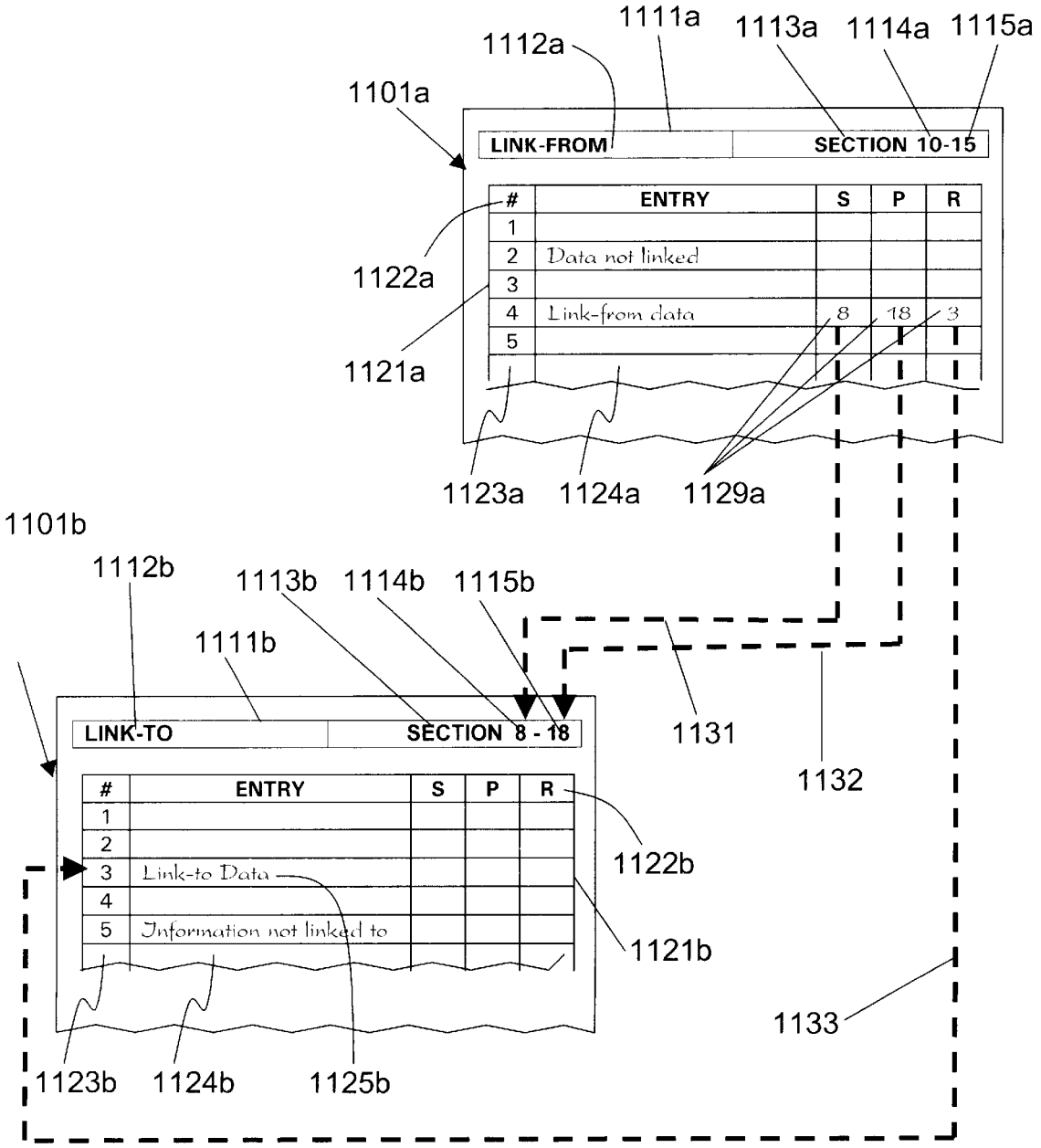

Operation of the Indexing System and Linking Methodology—Seven Cases based on the form defined in FIG. 7 herein referred to as the standard form FIG. 11 is a partial view of the upper portion of two uniquely identified pages each representing a portion of the standard form and used to illustrate the basic indexing system and linking methodology in accordance with an embodiment of the present invention.

Figure 12:
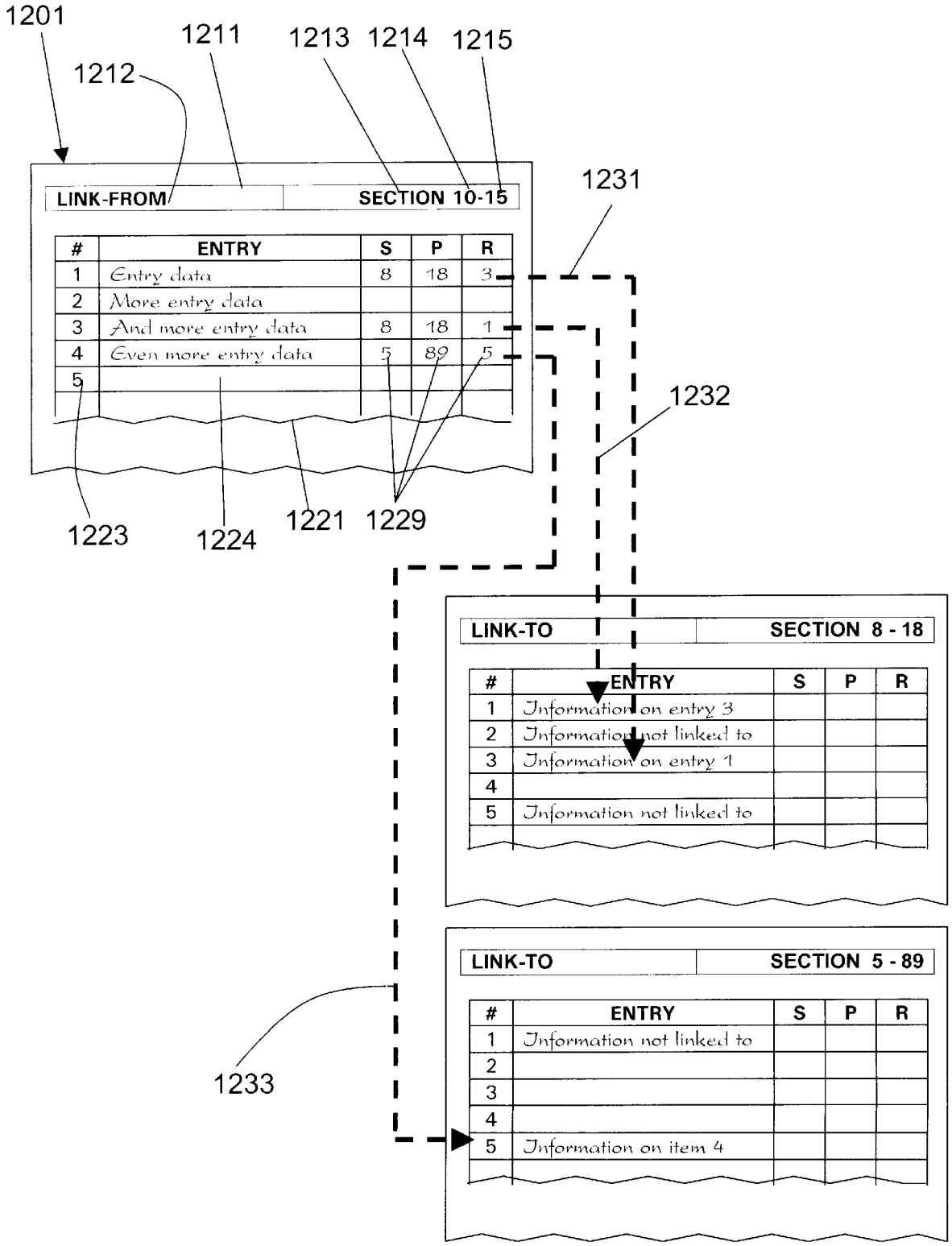

FIG. 12 is a partial view of the upper portion of three uniquely identified pages each representing a portion of the standard form and used to illustrate the methodology by which several links from several entries on one page are made to a plurality of entries on a plurality of pages located anywhere in the assembly of informational items in accordance with an embodiment of the present invention.

Figure 13:
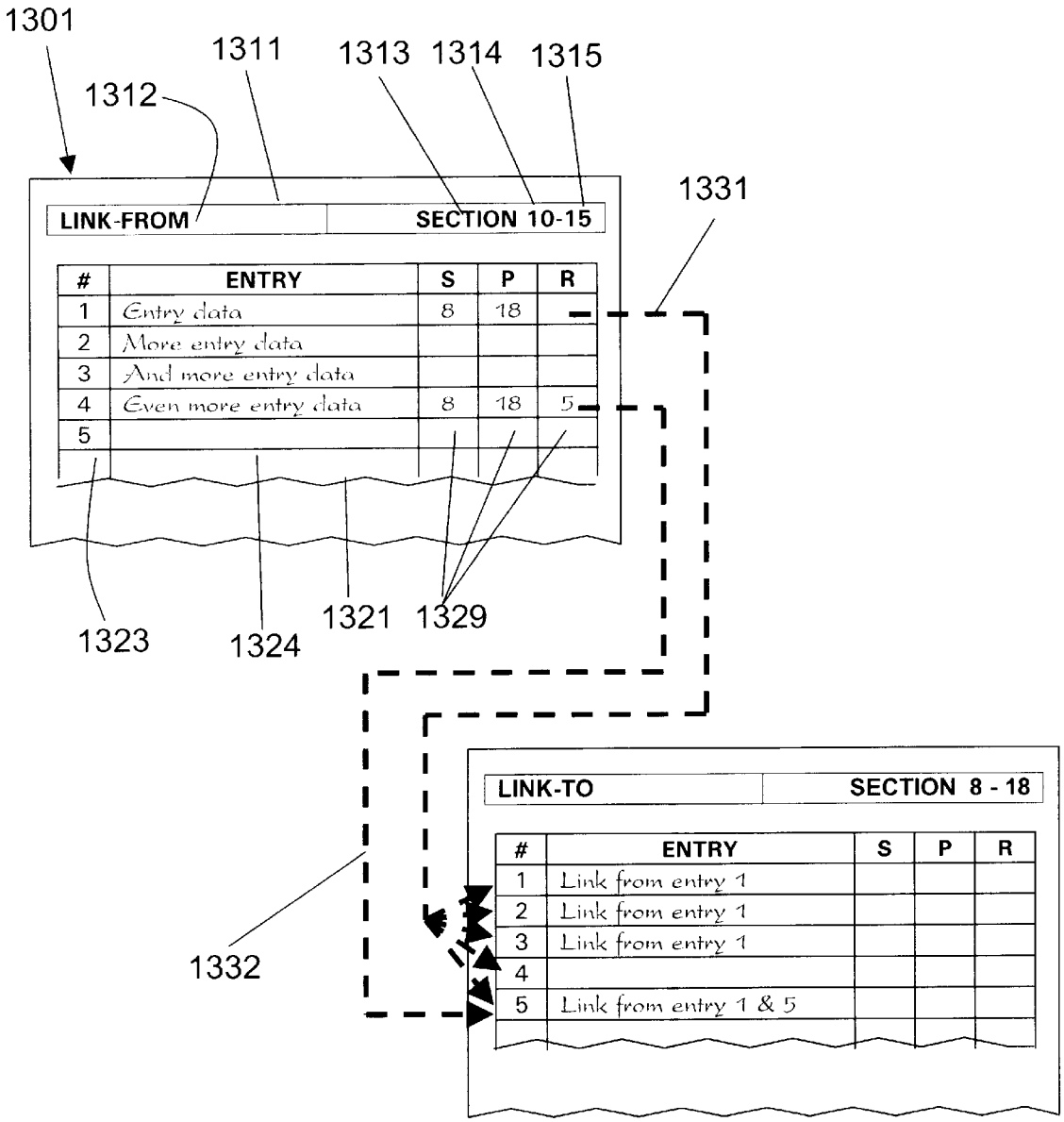

FIG. 13 is a partial view of the upper portion of two uniquely identified pages each representing a portion of the standard form and illustrating the methodology by which a link-from an entry in one record is made to a plurality of sequential records on another page anywhere else in the assembly of informational items in accordance with an embodiment of the present invention.

Figure 14:
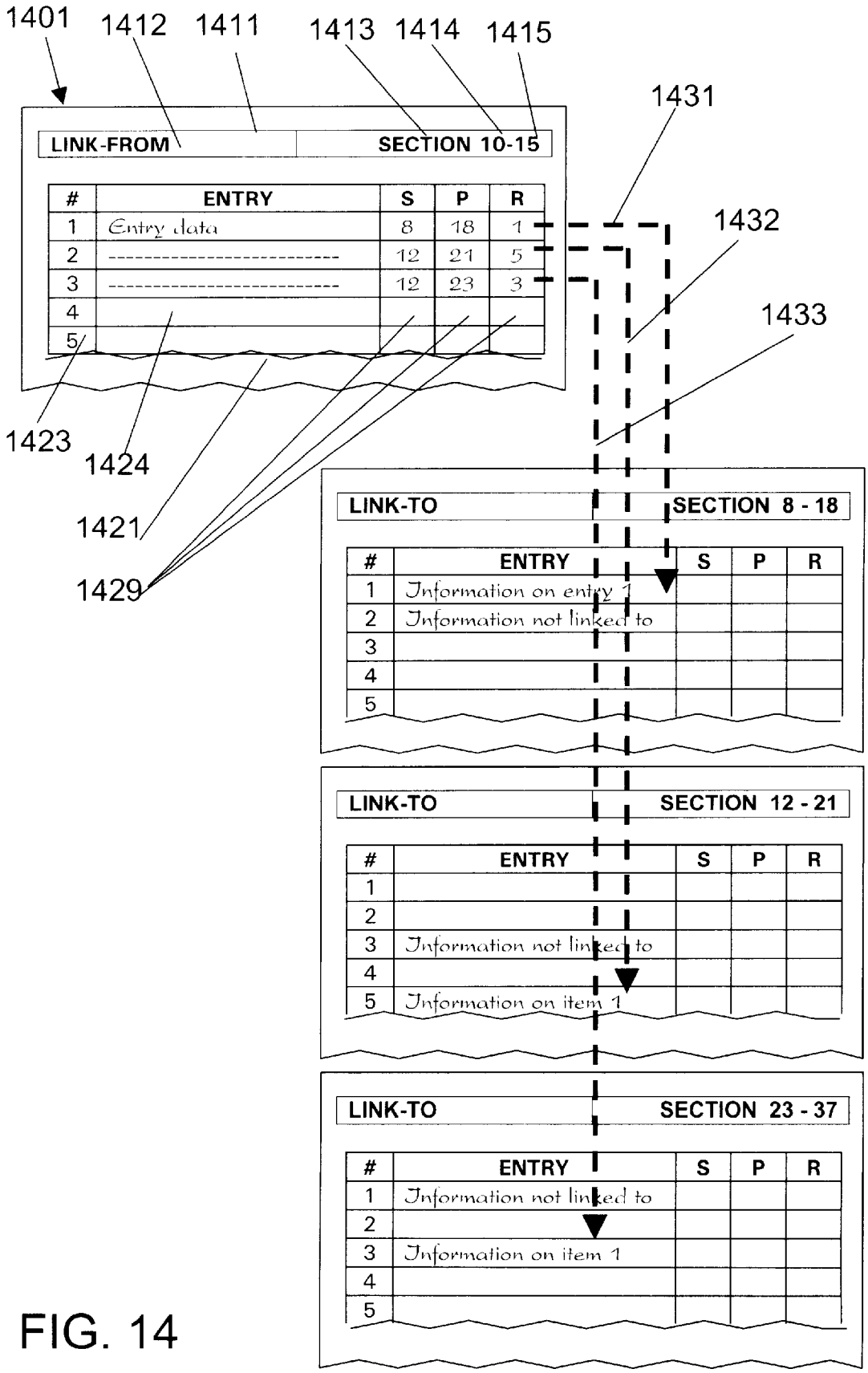

FIG. 14 is a partial view of the upper portion of four uniquely identified pages each representing a portion of the standard form and illustrating the methodology by which a single entry in one record can be linked to a plurality of non sequential records on a plurality of pages anywhere in the assembly of informational items by using a sequence of contiguous records in the form table from which the link is made in accordance with an embodiment of the present invention.

Figure 15:
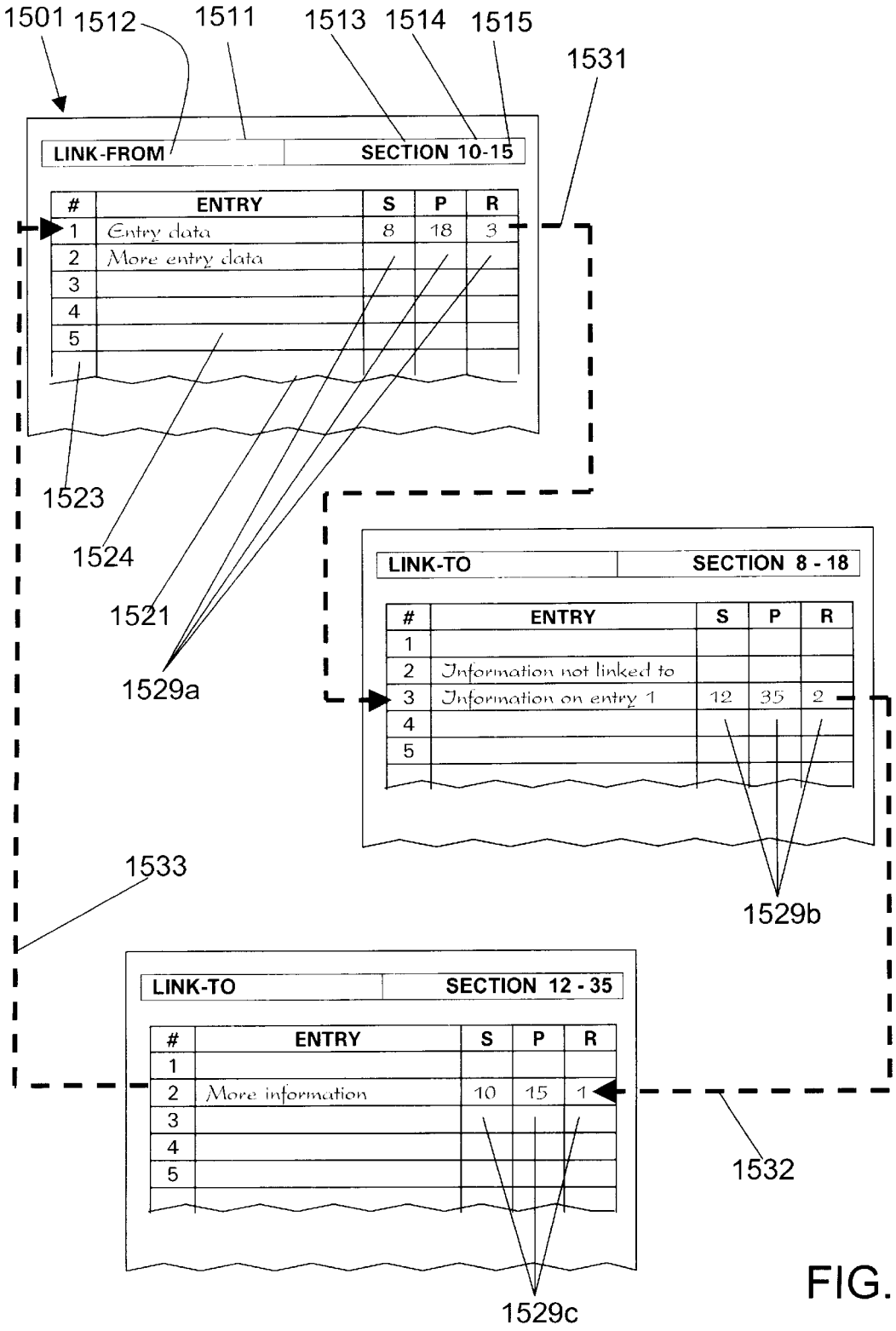

FIG. 15 is a partial view of the upper portion of three uniquely identified pages each representing a portion of the standard form and illustrating the methodology by which a circular set of links may be created in the assembly of informational items in accordance with an embodiment of the present invention.

Figure 16:
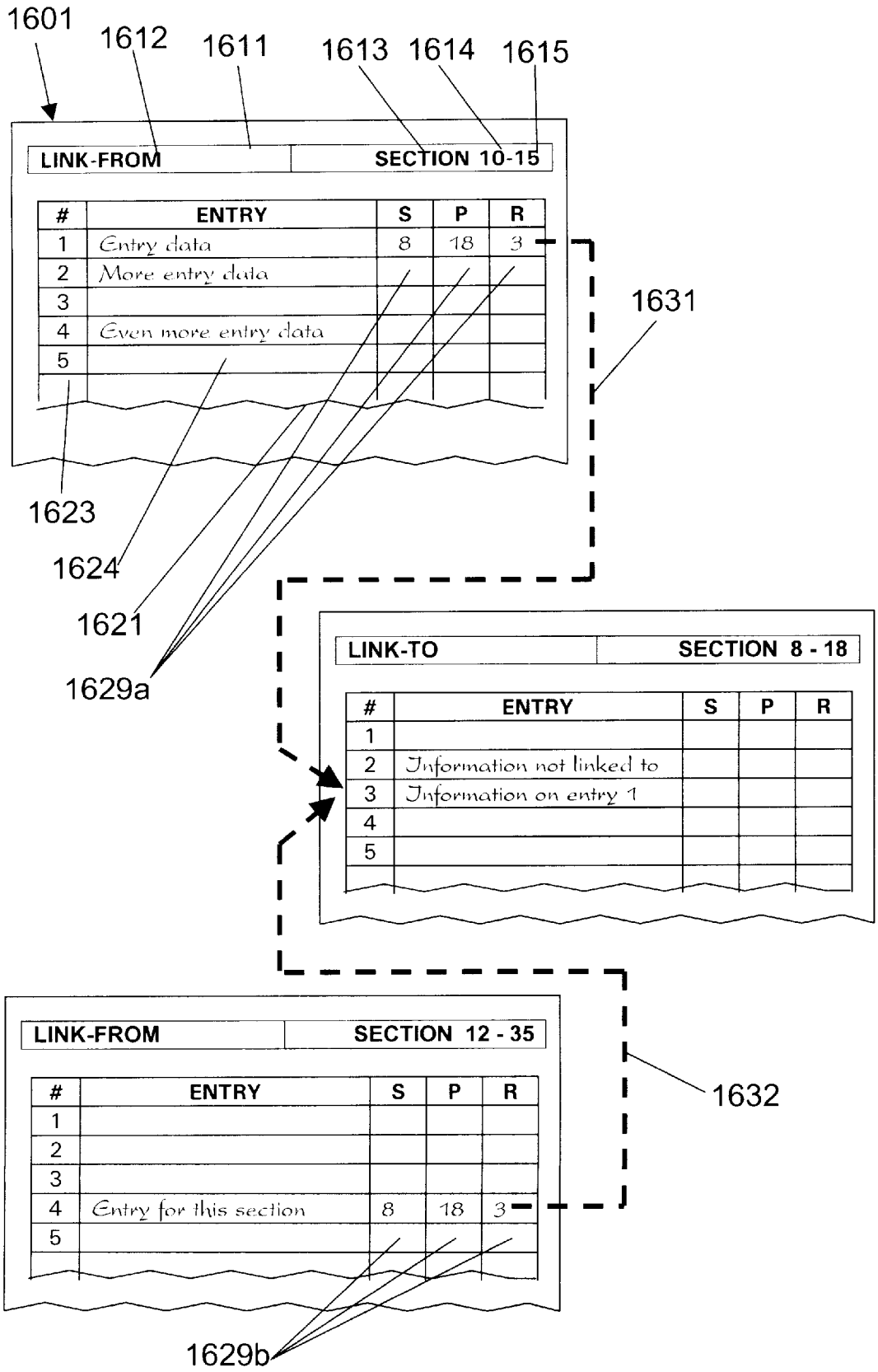

FIG. 16 is a partial view of the upper portion of three uniquely identified pages each representing a portion of the standard form and illustrating the methodology by which a plurality of separate record entries may be linked to a single record located anywhere in the assembly of informational items in accordance with an embodiment of the present invention.

Figure 17:
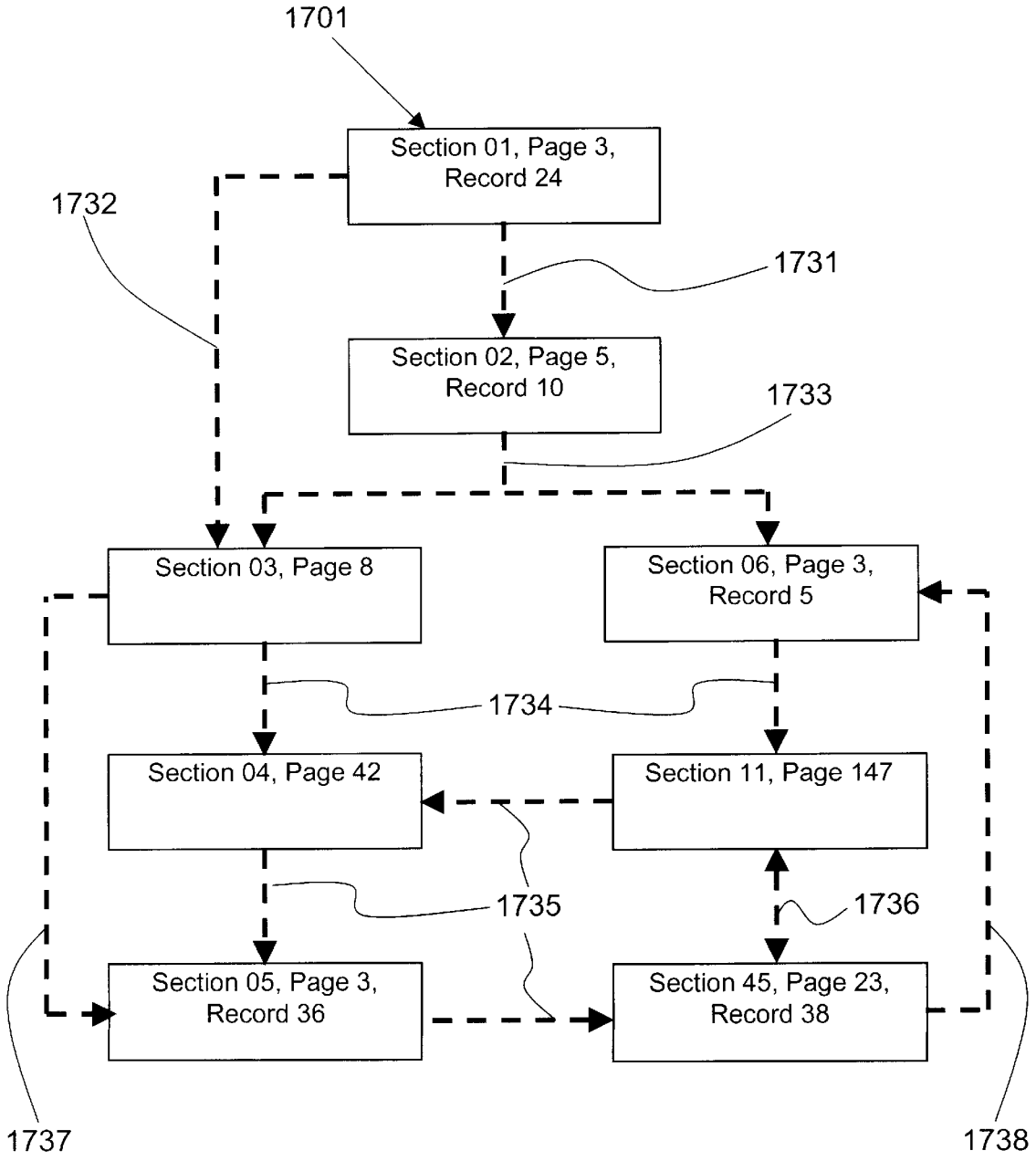

FIG. 17 is a schematic representation of eight separate pages having a plurality of records located in eight separate sections in an assembly of informational items and illustrating the creation of a complex compound document utilizing the previously described linking methodologies in accordance with an embodiment of the present invention.

Application of the Indexing System and Linking Methodology to a Working Model

Figure 18:
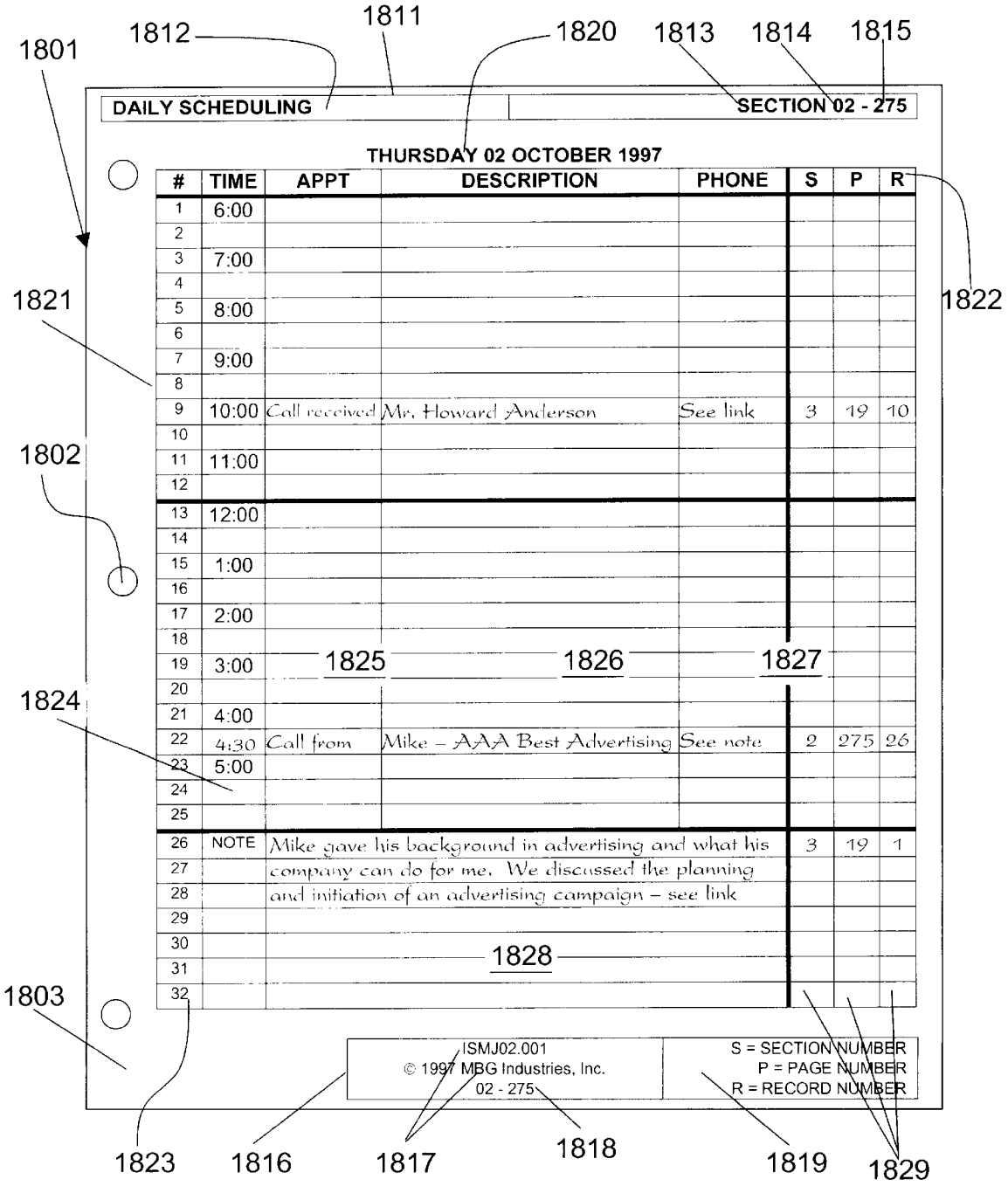
Figure 20:
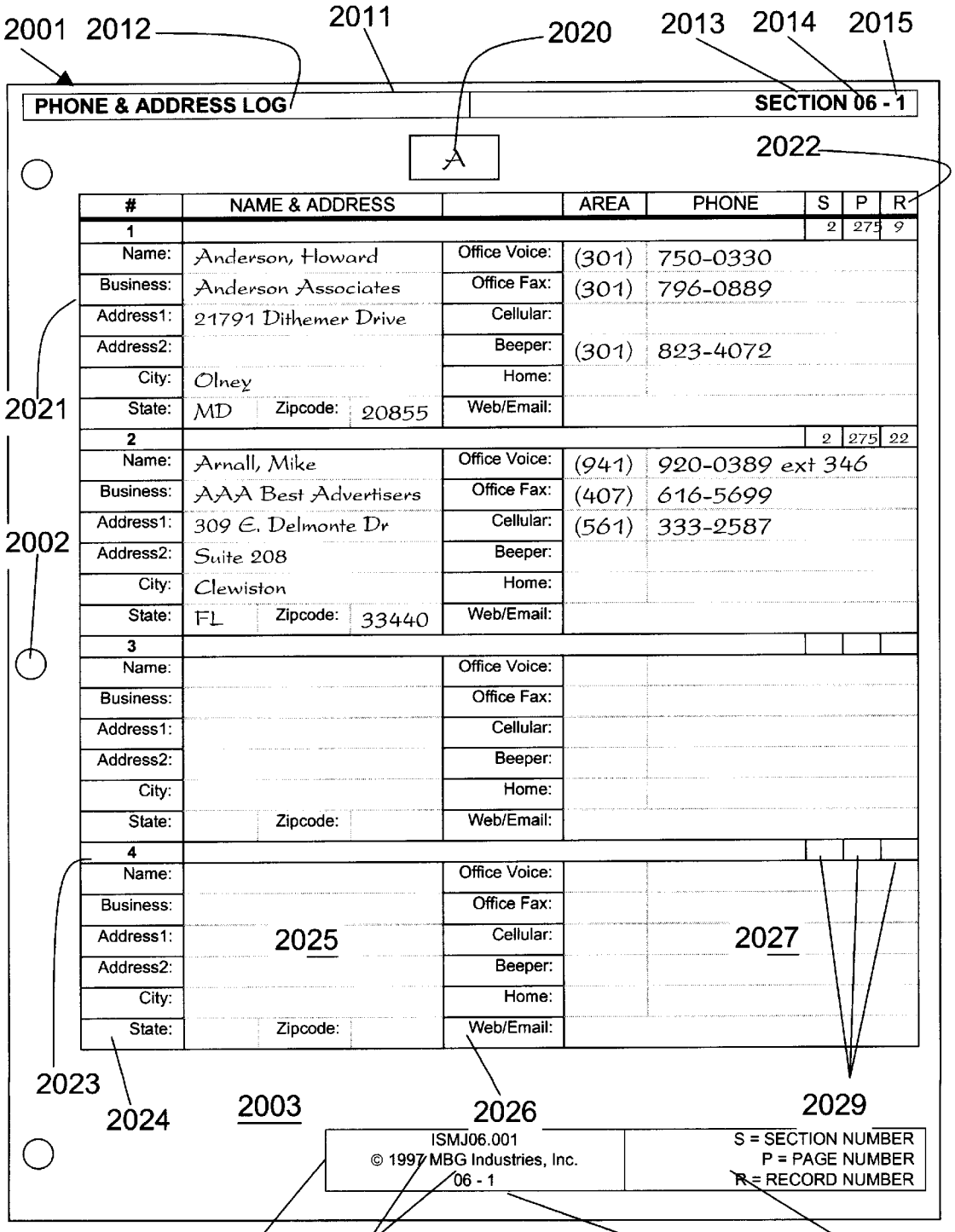

FIG. 18 is a two-dimensional view of one side of a daily scheduling form removed from its section and, in conjunction with FIGS. 6, 19, and 20 illustrates the application of the indexing system and linking methodologies in a working model in accordance with an embodiment of the present invention.

FIG. 19 is a two-dimensional view of one side of a planning, progress, and analysis form removed from its section and, in conjunction with FIGS. 6, 18, and 20 illustrates the application of the indexing system and linking methodologies in a working model in accordance with an embodiment of the present invention.

FIG. 20 is a two-dimensional view of one side of a phone and address form removed from its section and, in conjunction with FIGS. 6, 18, and 19 illustrates the application of the indexing system and linking methodologies in a working model in accordance with an embodiment of the present invention.

Integration of Journal and Document File Systems

Figure 21:
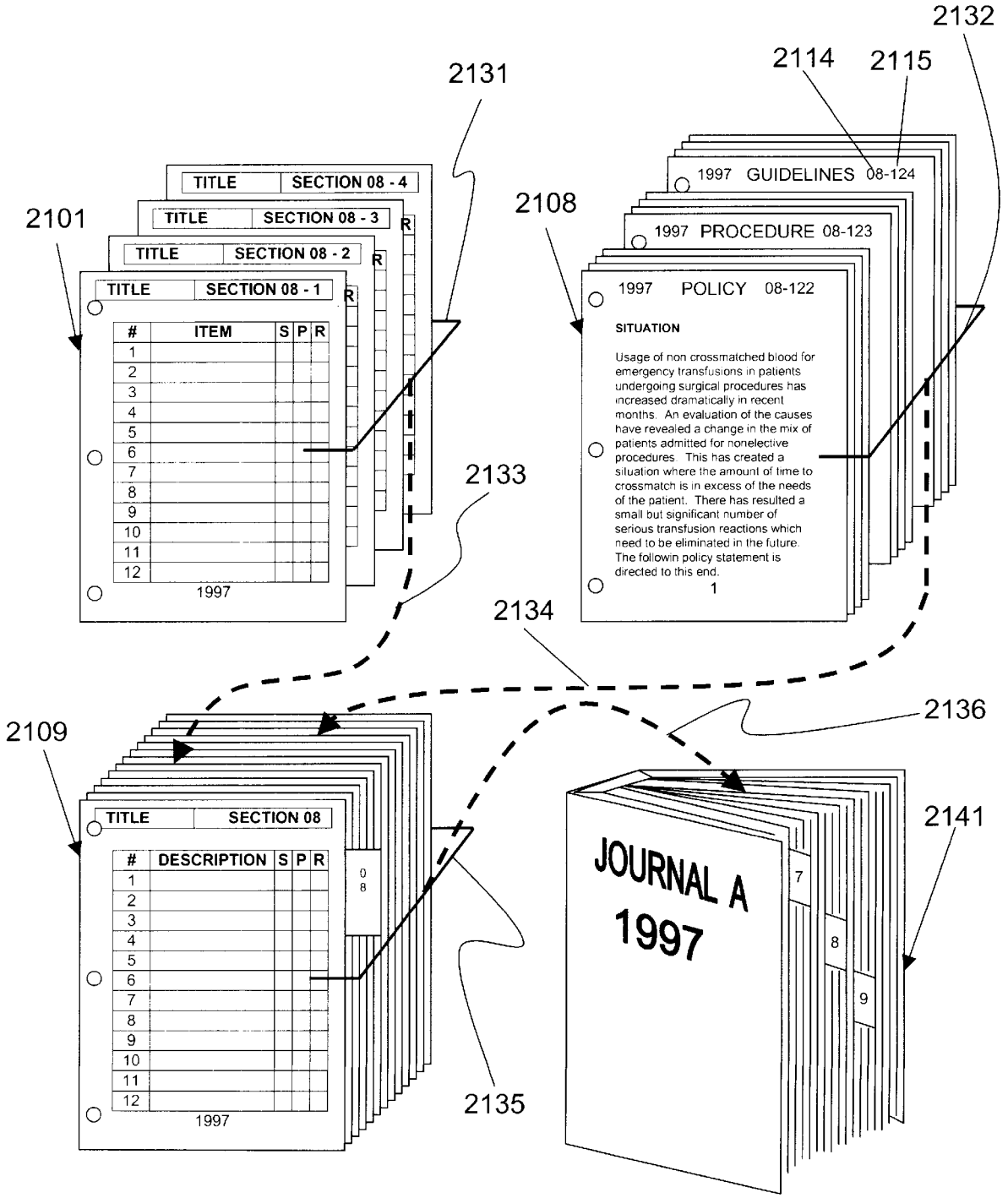

FIG. 21 is an illustration of the indexing, ordering, and assembly of a plurality of forms and documents into a uniquely identified section using a tabbed section divider and the inclusion of said section of forms and documents into a uniquely identified journal in accordance with an embodiment of the present invention.

Figure 22:
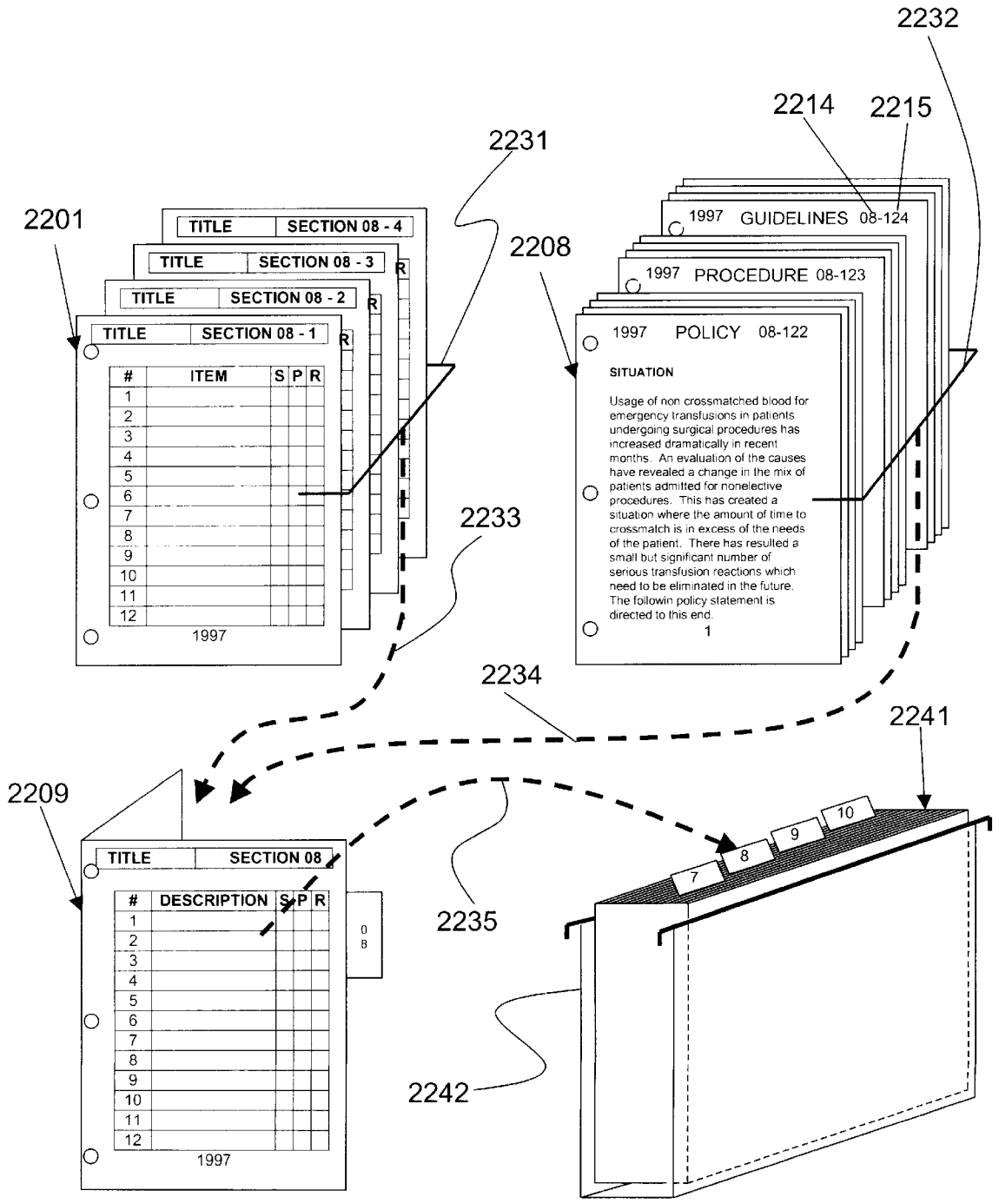

FIG. 22 is an illustration of the unique identification, ordering, and assembly of a plurality of forms and documents into a uniquely identified tabbed section file folder and the inclusion of said section file folder into a uniquely identified file box placed in a hanging file holder in accordance with an embodiment of the present invention.

Figure 23:
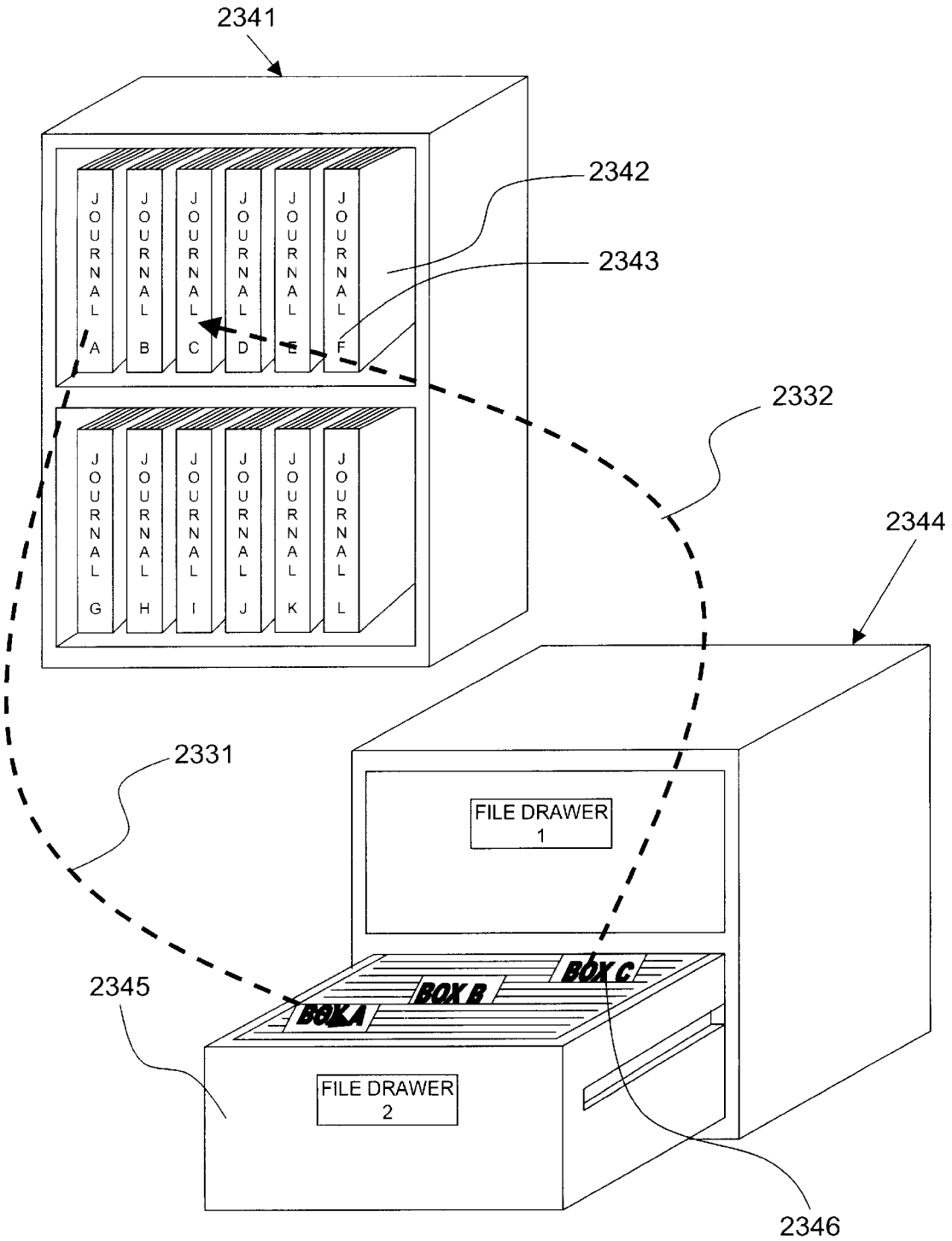

FIG. 23 is a three-dimensional orthogonal view of a book case with shelving having a plurality of journals stored in it, a file cabinet with drawers having a plurality of file boxes stored in it, and illustrating that a plurality of forms and documents in a plurality of journals may be disassembled and stored in a plurality of file boxes, and a plurality of forms and documents in a plurality of file boxes located in a plurality of file cabinets may be reassembled and moved to a plurality of journals in accordance with an embodiment of the present invention.

Application of the Indexing System and Linking Methodology to Automated Computer Systems FIG. 24 is a partial view of two different ordered views of the same tabular data stored on electronic-based media representing a table holding indexing and linking information about a paper-based informational assembly in accordance with an embodiment of the present invention.

FIG. 25 is a partial view of three separate tables, related to each other by unique indicum stored in their data fields and used to store information describing and defining the structure of the informational divisions as represented in an assembly of informational items stored on electronic-based media in accordance with an embodiment of the present invention.

FIG. 26 is a partial view of five separate tables, related to each other by unique indicum stored in their data fields and used to store an assembly of informational items on electronic-based media while maintaining all index and linking information exactly as they are in said paper-based assembly of informational items defined herein above in accordance with an embodiment of the present invention.

DETAILED DESCRIPTION OF THE PREFERRED EMBODIMENT

Theory of Forms, Tables, Records, and Fields as a Basis for the Present Invention The significance of the present invention is best understood by presenting the basic theory about and description of the components that make up the structure upon which the system and methods are based.

Informational Divisions May Create an Informational Hierarchy

To facilitate indexing and linking each item in an informational assembly may be assigned an alphanumeric and/or symbolic indicum. To further facilitate indexing and linking, a plurality of informational divisions may be defined and represented by alphanumeric and/or symbolic indicia. Each said division indicum may demarcate and, in whole or part, identify another division contained therein, and each said division may be demarcated and, in whole or part, identified by the indicia of other divisions it is contained within. A plurality of said divisional indicia defines an hierarchy of divisions wherein each said division indicia may demarcate and, in part, identify an item of information contained therein. The concatenation of the subset of said division indicia that define an hierarchy of divisions contained one within the other along with said indicum assigned to an informational item demarcated by and contained within the lowest division in the said hierarchy defines a unique, compound identifier for said informational item. An index may be constructed as a list of the compound identifiers thus defined and these identifiers may simultaneously represent a logical ordering, a physical holder, and a location of said informational items.

Structuring of the Informational Divisions into Tables

Said compound identifiers constitute additional informational items contained within the informational assembly for which they are created. Indexing and linking may be further enhanced by representing said indicia as ordered lists of informational items defining a table. Therefore, a table may represent a single division in the informational hierarchy. Each entry in the list represents both an informational division and a record in the table. Each record may be further enhanced by defining entry fields each of which is assigned to hold a specific type of information that is repeated in each record of said table.

Application of Theory to the Technical Aspects of Form and Document Design

Physical Representation of Information Stored in Tables

Information stored in tables may also be displayed on a paper surface and electronic-based displays. The organization of informational displays dictates how an indexing system and linking methodology will work.

Figure 1:
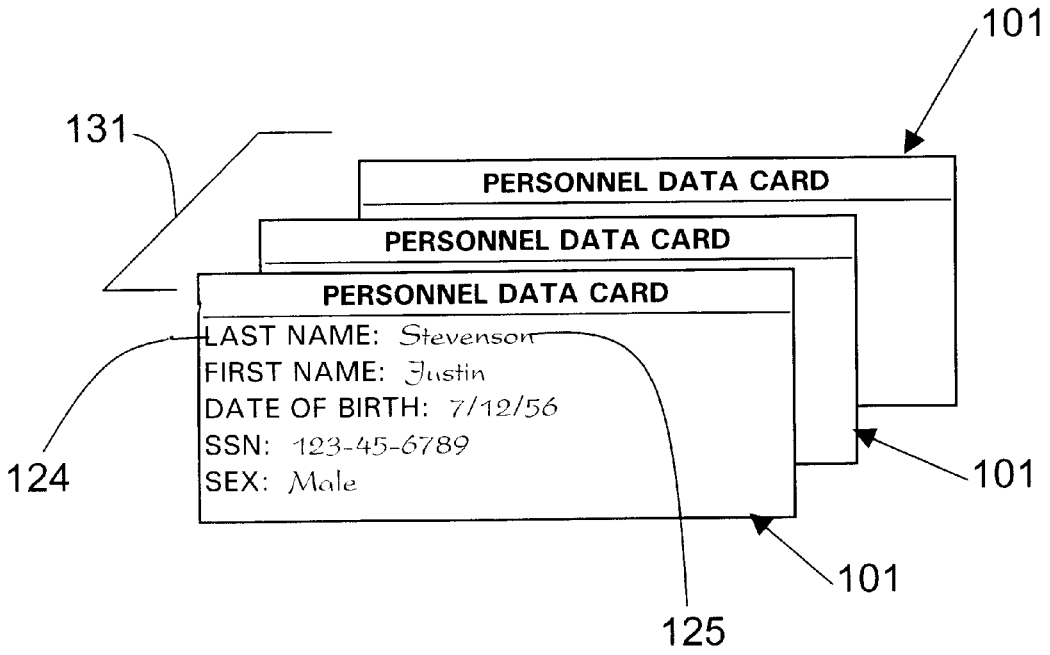
FIG. 1 PRIOR ART
FIG. 1 is a perspective view illustrating a group of three overlapping catalog cards showing five field labels on the left and five field entries to the right of each label in accordance with the prior art.

Card Record Object (CRO) Defined as a Table Consisting of Form-pages: FIG. 1

A table of records may be displayed as a card catalog system consisting of a plurality of forms (101) each printed on at least one sheet of paper or, a more rigid printable and markable material, or displayed on a video monitor herein referred to as a form-page. Each form-page (101) usually has an identical set of uniquely defined fields usually identified by a preprinted label (124) and an entry field (125) positioned to the immediate right with printed or hand marked entries consisting of alphanumeric, textual, symbolic, and/or graphic information. Each set of entry fields is organized on the form-page (101) in a non-tabular structure herein referred to as a Card Record Object (CRO). A plurality of said CRO's grouped together defines a table of forms (131). The form-pages (101) are placed one behind the other in an organized sequence determined by the entries in one or more fields herein after referred to as record identification or record indexing fields. Forms may be constructed from a plurality of sheets and each side may be used to position a plurality of entry fields and associated labels.

Page-Record Object (PRO) Defined as a Modification of the CRO into a Table of Page-Records That May Contain Other Tables: FIG. 2

The above said card catalog structure may be modified to order a set of pages within a plurality of forms so as to represent separate records belonging to a plurality of tables and, therefore, allows the representation of a plurality of informational subdivisions as ordered collections of paper sheets herein below referred to as page-records. The resulting CRO positioned on the page-record, is a grouping of a plurality of entry fields and preprinted information organized into a plurality of rectangular zones herein referred to as page-record objects (PRO's) usually located at the top of a page-record (201) as a header (211) and/or at the bottom of a page-record (201) as a footer (216). In this example the header (211) consists of an unlabeled, preprinted title field (212) located in the upper left-hand corner of the page-record (201), along with a preprinted field label (213), the preprinted unlabeled section indicia entry field (214) a hyphen, and an unlabeled preprinted page-record indicia field (215) located in the upper right-hand corner of the page-record (201). A plurality of other fields may also be defined in a PRO as will be illustrated herein below. In this example the footer (216) consists of seven preprinted field entries. Located centrally are the unlabeled, preprinted version and manufacturing dates fields (217) beneath which are located unlabeled, preprinted section indicia and page-record indicia fields (218) separated by a hyphen. At the bottom right-hand corner of the page (201) are a set of preprinted fields (219) without labels which provides the user with information About the form. Although a page-record (201) may only have one PRO made up of a header and footer (211 and 216 together), the contents of any field in said PRO may be displayed in a plurality of locations on the surface (214 and 215) and (218).

The Table Record Object (TRO) Defined as a Tabular List Structure Positioned on a Form-page to extend the Informational Hierarchy: FIG. 3

Shown is a partial view of the center of a single page-record (301) of a form containing a plurality of other records organized as a table (321), herein below referred to as a Table Record Object (TRO), consisting of a list of items, usually similar such as names, dates, address, and other information organized physically on the page-record (301) in separate fields defined by a plurality of vertically oriented columns (341) (gray shading for illustrative purposes only) and horizontally oriented rows (342) (gray shading for illustrative purposes only) which may be demarcated by a plurality of vertical and horizontal lines (343). Each column (341) represents a single field in a row (342) and defines its order within the row on that page. Each row (342) represents an identical record of fields in the table (321). Each column (341) may have a header defined by a preprinted label located at its top indicating the position of the field in each record. A plurality of these preprinted labels define a table header (322). Each row (342) may be prefixed by a field (323) reserved for preprinted record indicia that may be used to establish said record's order in the table thus providing the means to index said record within the hierarchy of informational divisions.

Figure 4:
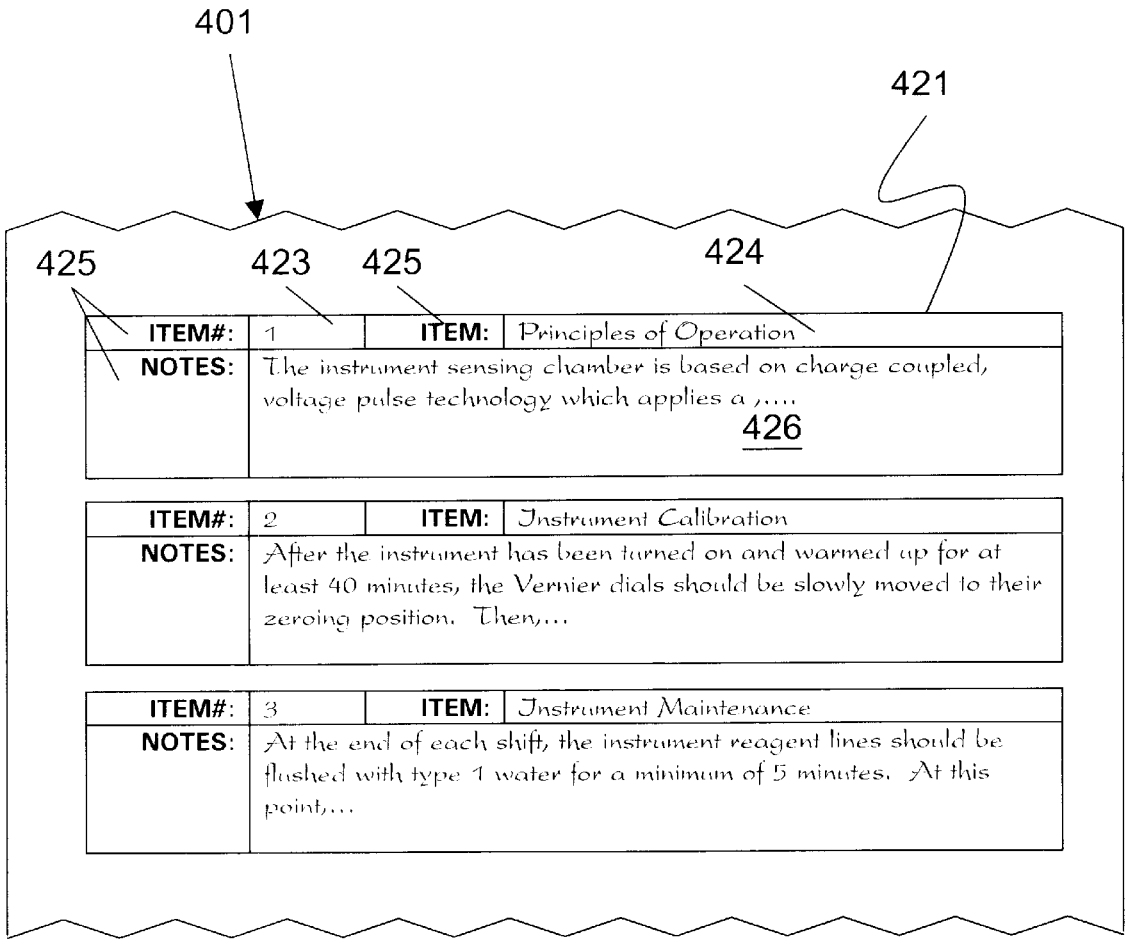
FIG. 4 PRIOR ART
FIG. 4 is a schematic view of a multiple card object with three records containing two one line and one free form entry fields illustrating data written into each field in accordance with the prior art.

Multiple Card Object (MCO) Defined as a Series of Card Catalog Structures Positioned on a Form-Page to enhance the Informational Hierarchy: FIG. 4

Tabular data may also be represented on a page-record by a plurality of individual CRO's (421) which are identical in structure to a PRO but differ in that a plurality of CRO's may be placed on a single page-record (401). This plurality of CRO's is herein referred to as a multi-card object (MCO). The MCO (421) usually looks like a set of CRO's positioned vertically, one below the other on the page-record surface.

Each may have a plurality of single line entry fields (423, 424) and field labels (425) This organization of records allows for positioning entry fields in a pattern other than tabular allowing for the inclusion of large, rectangular areas (426) for entry of free-form alpha numeric and graphic information.

There are many alternative embodiments of the MCO. One is a rectangular grid wherein each column represents a record instead of entry field allowing a further subdivision of informational items below the level of the MCO. Each record may, in turn contain one or more entry fields organized as a catalog card, or if room permits, may contain a entire table within its boundaries (not shown). Another commonly available example of this type of MCO is the monthly calendar with days organized into weeks horizontally across the page and weeks organized as months vertically down the page (not shown).

Application of PRO, TRO, and MCO Structures to the Organization and Display of Informational Divisions on a Page-Record Within a Form When used together in a plurality of combinations the PRO, TRO, and MCO allow for the design of flexible and useful data entry forms and documents consisting of PRO header and footer with a plurality of TRO's and/or MCO's located across the remaining space provided on the display surface. TRO's may contain other TRO's and/or MCO's as part of their record structure and MCO's may contain other MCO's and/or TRO's as part of their record structure allowing for a plurality of subdivisions of informational items on one page or display. These objects provide the structural basis from which the present embodiment of the invention is designed and described herein below.

Physical Structure Representing the Hierarchy of Informational Divisions

The above said divisional hierarchy may be further applied to a plurality of physical modalities such as a plurality of releasably bound journals and/or file boxes each containing and an ordered set of section tab dividers and/or tabbed section file folders, each said divider or folder, in turn, demarcating or containing an ordered set of forms and documents, each said form and document, in turn, containing an ordered set of page-records, each said page-record, in turn, containing an ordered set of tables, each said table containing an ordered set of informational records displayed as TRO's or MCO's. This same said hierarchy may also be stored on a plurality of electronic-based media. This allows for the creation of an organizational structure which allows for the incorporation of a unique index system and linking methodology presented herein below.

The Journal System Structure

The Journal: FIG. 5

In an embodiment of the present invention, the journal consists of a standard sized notebook (501) that can be obtained commercially consisting of a rigid spine (541) with a set of three metal rings (not shown) which may be opened by a key release mechanism (542). Attached along each vertical edge is a front panel (543) and back panel (544) made of rigid or semi-rigid material onto which may be printed or hand marked identifying information herein shown as "JOURNAL A 1997" (545). Releasably bound tabbed section dividers (546) as defined herein below in FIG. 6 and paper pages (547) as defined herein below in FIG. 7 are manufactured, cut, or folded to fit into the rectilinear space defined by the journal spine and panels. Said dividers (546) and pages (547) are three-hole punched so that when placed on the three metal rings are freely movable around the circumference of the rings and lay flat for viewing and hand marking of both surfaces when the front (543) and back (544) panels of the journal (501) are separated to expose its contents. The journal herein defined is also referred to as a type of divisional holder herein below.

Section Record Object (SRO) Defined as the Tabbed Section Divider: FIG. 6

In an embodiment of the present invention, a tabbed section divider is constructed from a rectangular shaped sheet of paper or other semi-rigid material (601) with two markable and printable surfaces (603) (only one shown) manufactured, cut, or folded to fit into the rectilinear space defined by the journal spine and panels also referred to as a divider herein below. Said divider (601) is punched with a plurality of holes (602) near one vertical margin allowing said divider (601) to be placed on the journal rings. Each divider (601) has a blade (604) of semi-rigid or rigid material with markable and printable surface attached at the opposite vertical margin so that it projects beyond the rectangular area of said divider surface (603) and hereafter referred to as a tab. The tab (604) is made large enough so that it can have symbols and alphanumeric indicia marked or printed on both surfaces. In the present embodiment of the invention the section information such as section title (612) and indicia (614) comprise a single record of fields in a table of sections. Therefore this section-record may be displayed as a section record object (SRO) in a manner identical to the page-record PRO. In addition, said section-record may contain a detail table used to store indexing information displayed as a TRO or MCO. Said section-record displays the following:

SRO header (611) consisting of preprinted section title (612) in the upper corner nearest the hole punched margin and a preprinted label cons sting of the word "SECTION" (613) with a pre-assigned section indicum field entry (614) printed in the upper corner opposite the hole punched margin.

SRO footer (616) consisting of a centrally located set of fields defining the form version and date of creation (617), with duplicate preprinted section indicum field entry and an additional preprinted indicum (618) abbreviating the word index as "IDX". Positioned at the bottom right-hand corner is a set of preprinted fields (619) without labels that provide the user with information about the form.

TRO (621) located between the SRO header and footer containing entry fields used for printing or marking a brief description of an informational item located elsewhere in said assembly of informational items, indexing, and linking information. In this embodiment, there is a table header (622) defining each field and its position in the table (621). The left-hand column (623) contains a set of preprinted indicum comprising a continuous sequence of unique and ordered whole numbers each assigned to a record and ordering all said records in the table (621). Said sequence is continued on the opposite side in the case of the divider. To the immediate right is a column (624) labeled "DESCRIPTION" for entry of descriptive information. The next three columns (629) are labeled "S", "P", and "R" representing the section link field, page link field, and record link field respectfully, hereafter referred to collectively as the linking fields.

A plurality of tabbed section dividers (601) ordered by their section indicia (614) and placed on the journal (501) rings or into file boxes (801) thereby define a plurality of informational divisions which allows for demarcating and ordering a plurality of preprinted forms (701), documents (1001), and other materials. A plurality of new tabbed section dividers (601) may be created and added to said set by assigning unique section indicia (614) to each. The number of said TRO records positioned on said tabbed section divider (601) may be increased by adding continuation sheets designed to match that of the original divider except with a continuation of the sequence of record indicia.

Standard Form Elements Defining a Plurality of Page-records: FIG. 7

In an embodiment of the present invention, a form consists of a plurality of rectangular shaped sheets of paper (701) or other flexible material with two markable and printable surfaces (703) (only one shown) manufactured, cut, or folded to fit into the rectilinear space defined by the journal spine and panels. Each surface is hereafter referred to as a page there being two per sheet of paper. Each said page also defines a page-record. Each sheet is punched with a plurality of holes (702) near one vertical margin allowing it to be placed on the journal rings. Each page of each form has a standardized set of preprinted labels and entry fields placed on its surface. These consist of the following:

PRO header (711) consisting of preprinted section title (712) in the upper corner nearest the hole punched margin and a preprinted label consisting of the word "SECTION" (713), pre-assigned section indicum field entry (714), and pre-assigned page indicum field entry (715) printed in the upper corner opposite the hole punched margin.

PRO footer (716) consisting of a centrally located set of fields defining the form version and date of creation (717), with duplicate preprinted section indicia field entry and page indicia field entry (718). At the bottom right-hand corner of the page are a set of preprinted fields (719) without labels which provides the user with information About the form.

TRO (721) located between the PRO header (711) and footer (716) containing entry fields used for printing or marking data, indexing, and linking information. In this embodiment, there is a table header (722) defining each field and its position in the table (721). The left-hand column (723) contains a set of preprinted indicum comprising a continuous sequence of unique and ordered whole numbers each assigned to a record and ordering all said records in the table (721). To the immediate right is a column (724) labeled "ENTRY" for entry of descriptive information by the user. The next three columns (729) are labeled "S", "P", and "R" representing the section link field, page link field, and record link field respectively and hereafter referred to collectively as the linking fields. Partial views of these five columns and the PRO header are used to illustrate the system and methodology proposed by the invention herein below. In addition to a single TRO, a plurality of TRO's and or MCO's may be positioned on the page-record, each displaying informational items organized as separate tables as illustrated herein below.

The Document System Structure

The file box: FIG. 8

In an embodiment of the present invention, the file box consists of a standard sized file box that can be obtained commercially and is constructed from a semi-rigid material such as cardstock. The file box is manufactured as a rectangular box (801) with front (842), back (843), sides (844), bottom (845) and an open top (846) through which a plurality of tabbed section folders, forms, documents, and other materials may be passed to store in the box (not shown for clarity). These materials are oriented so that one vertical edge is accessible at or near the open top (846) of the box (801). A tab (847) is attached at any point along the top horizontal edge of either the front (842) or back (843) of the box (801) and is used to provide a means of uniquely identifying the box (801) in a file index system. The box (801) herein defined may be placed in commercially available file cabinet drawers, on commercially available shelves, and in commercially available hanging file holders. The file box herein defined is also referred to as a type of divisional holder.

Section Record Object (SRO) Defined as the Tabbed Section File Folder: FIG. 9

In an embodiment of the present invention, a tabbed section file folder is constructed from a rectangular shaped sheet rigid or semi-rigid material (901) with two markable and printable surfaces manufactured, cut, and folded to fit into the rectilinear space defined by the journal spine and panels and file box. The fold (905) creates two roughly equal sized panels (903,906) which when closely opposed create an interior space (907) into which a plurality of forms, documents, and other materials may be placed. Each panel (903,906) of the file folder (901) is punched with a plurality of holes (902) near the vertical margin defined by the fold line (905) allowing the folder to be placed on the journal rings. Each folder (901) has a blade (904) of semi-rigid or rigid material with markable and printable surface attached at the vertical margin opposite the fold (905) so that it projects beyond the rectangular area of the divider surface hereafter referred to as a tab. The tab (904) is made large enough so that it can have symbols and alphanumeric indicia marked or printed on both surfaces. In the present embodiment of the invention the section information such as section title (912) and indicia (914) comprise a single record of fields in a table of sections. Therefore just as with the tabbed section divider herein above, this section-record may be displayed as a section record object (SRO) in a manner identical to the page-record PRO. In addition, said section-record may contain a detail table used to store indexing information displayed as a TRO or MCO. Said section-record displays the following:

PRO header (911) consisting of preprinted section title (912) in the upper corner nearest the hole punched margin and a preprinted label consisting of the word "SECTION" (913) with pre-assigned section indicum field entry (914) printed in the upper corner opposite the hole punched margin.

PRO footer (not shown so as to avoid obscuring dashed lines indicating the back panel of the form) being substantially identical to that define for above said tabbed section divider in FIG. 6.

TRO (921) located between the PRO header and footer containing entry fields used for printing or marking indexing and linking information. In this embodiment, there is a table header (922) defining each field and its position in the table (921). The left-hand column (923) contains a set of preprinted indicum comprising a continuous sequence of unique and ordered whole numbers each assigned to a record and ordering all said records in the table (921). Said sequence is continued on the opposite side in the case of the divider. To the immediate right is a column (924) labeled "DESCRIPTION" for entry of descriptive information by the user. The next three columns (929) are labeled "S", "P", and "R" representing the section link field, page link field, and record link field respectfully and hereafter referred to collectively as the linking fields.

A plurality of tabbed section file folders (901) ordered by their section indicia (914) and placed on the journal (501) rings or into file boxes (801) thereby define a plurality of informational divisions which allows for demarcating and ordering a plurality of preprinted forms (701), documents (1001), and other materials. A plurality of new tabbed section file folders (901) may be created and added to said set by assigning unique section indicia (914) to each. The number of said TRO records positioned on said tabbed section file folder (901) may be increased by adding continuation sheets designed to match that of the original divider except with a continuation of the sequence of record indicia.

Standard document elements: FIG. 10

In an embodiment of the present invention, a document consists of a plurality of rectangular shaped sheets of paper (1001) or other flexible material with two markable and printable surfaces (1003) manufactured, cut, or folded to fit into the rectilinear space defined by the file box. Each surface is hereafter referred to as a page there being two per sheet of paper. Each sheet is punched with a plurality of holes (1002) near one vertical margin allowing it to be placed on the journal rings. Each page of each form has a standardized set of preprinted labels and field entry fields on its surface. These consist of the following:

PRO header (1011) consisting of preprinted section title (1012) in the upper corner nearest the hole punched margin and a preprinted label consisting of the word "SECTION" (1013), pre-assigned section indicia field entry (1014), and pre-assigned page indicia field entry (1015) printed in the upper corner opposite the hole punched margin.

PRO footer (1016) consisting of a centrally located set of fields defining the form version and date of creation (1017), with duplicate preprinted section indicia field entry and page indicia field entry (1018). At the bottom right-hand corner of the page are a set of preprinted fields (1019) without labels which provides the user with information about the form.

TRO (1021) located between the PRO header and footer containing entry fields used for printing indexing, textual, and graphic entries, as well as linking information. In this embodiment, there is a table header (1022) defining each field and its position in the table (1021). The left-hand column (1023) contains a set of preprinted indicum comprising a continuous sequence of unique and ordered whole numbers each assigned to a record and ordering all said records in the table, (1021). To the immediate right is a column (1024) labeled "TEXT". Beneath this label is a rectilinear area within which continuous text is printed so that each line of text corresponds to one of the record indicia and one set of linking fields as defined herein. The next three columns (1029) are labeled "S", "P", and "R" representing the section link field, page link field, and record link field respectfully and hereafter referred to collectively as the linking fields. A graphic item (1030) is inset within the textual column (1024) without obscuring any of the text. It is assigned its own unique record indicum as a continuation of the textual record indicia, and is assigned a set of three labeled linking fields.

Operation of the Index System and Linking Methodology

The Index System: Creating Unique Identifiers for each Informational Item in the Assembly The Integrated Systems Management Journal The Integrated Systems Management Journal, herein referred to as the journal system, provides a plurality of journals (501) defined herein above, wherein may be placed a plurality of tabbed section dividers (601) demarcating a plurality of preprinted forms (701) and other materials each consisting of a plurality of page-records placed behind said section divider (601). Each page-record may, in turn, contain a plurality of preprinted entry records organized in TRO's and/or MCO's within which printed and marked informational items may be stored in fields. From this structural representation of informational divisions a unique indicum may be constructed from preprinted data for each informational item in the journal system as follows:

Section Number

In an embodiment of the present invention each section is assigned a unique identifier chosen from the set of whole numbers defined as an ordinal sequence of elements starting with zero (0) represented as:

$$[0,1,2,3,4,5, \ldots \infty]$$

The assignment defines an ordinal sequence starting with a whole number selected from said set and incremented by adding another whole number. If a new section tab divider is added to the journal system it is assigned the next larger, unused number in said sequence. A sequence number is never assigned to more than one division within any journal. This structure assures that there will be a unique section number for each page-record across the entire journal system.

Page Number

In an embodiment of the present invention each section may contain a plurality of preprinted forms each consisting of a plurality of pages. Each page in a section is assigned a unique identifier from a set of whole numbers utilizing the above said methodology for section indicia. A separate set of whole numbers is used for each section allowing for the continuous reuse of the smaller numbers in the ordinal sequence. The numbering is by page, not by form. Therefore, if a form is 4 pages long and these are assigned the sequence 1 through 4, then the second copy of that form would have its four pages numbered 5 through 8, the third 9 through 12, and so one to the end of that section. This assures that there will be a unique page number for each single side of each sheet of paper of each form within each section. A previous assigned page number is never reused within its section, even if some of the pages in the journal system are removed. Additional pages added at a latter time are assigned a numeric identifier utilizing the above said methodology for addition of new section indicia.

Record Number

In an embodiment of the present invention each page-record will contain a plurality of tables displayed as entry records preprinted on each page. Each record on a page is assigned a unique preprinted identifier from a separate set of whole numbers utilizing the above said methodology for section indicia and page indicia. The record numbering is by each side of each page, not by form or by table. Therefore, in the present embodiment each side of each sheet of paper in the form will have a plurality of uniquely numbered records starting with the number one (1). Therefore, if there are a plurality of tables displayed on one page, then the record numbering will be a single sequence of unique numbers spanning both tables. Any new form designed at a later date must comply with this design feature to assure that all records will be identified uniquely across each of its constituent pages.

Constructing the Unique Identifiers

In order to uniquely identify a single record in said journal the section, page, and record numbers are concatenated into a unique record identification sequence as follows:

SECTION#-PAGE#-RECORD#

Therefore, record number 15 on page 10 of section 2 is written as:

2010-15

Other identifiers may be constructed from this structure such as a section-page or a page-record compound identifier. As will be shown herein, any portion of this three-part identifier may be used to index and link informational items in the journal system.

In the case where more than one journal is used to constitute a journal system, each record is uniquely identified across the entire system of journals by one of two implementations of the system of hierarchical identifiers. Either a four-part compound identifier is constructed from the journal, section, page, and record indicia or, the section identifiers are defined as a single set of whole numbers for all journals in the system whereby the three-part compound identifier defined above maintains the uniqueness of each record.

The Integrated Systems File

The Integrated Systems File, herein referred to as the filing system, provides a plurality of file boxes (801) as defined herein above in FIG. 8 wherein may be placed a plurality of tabbed section file folders (901), each said section demarcating a plurality of preprinted documents (1001) and other materials each consisting of a plurality of pages bound or unbound. Each page may contain a plurality of preprinted entry records within which printed and marked informational items may be stored in fields. From this structural representation of informational divisions a unique identifier may be constructed for each informational item in the filing system. However, due to the complexity of documents and fact that most existing documents will not be published utilizing the structure herein described, a plurality of indexing systems must be applied:

Documents Designed to Meet Indexing Requirements Herein Above Defined for the Journal System As illustrated in FIG. 10 herein above, documents may be defined as special types of forms wherein each line of text on a page occupies an entry field within a tabular set of records, each record being a continuation of the previous line, this set of textual records continuing onto succeeding pages until the end of the document. All graphic elements are assigned a record identifier by continuing to increment the ordinal record number sequence for that page and applying this to each. This structure allows the application of the same indexing system as defined for said journal system herein above. When said design is applied the design of a document it is hereafter referred to as an internal document.

Internal Documents Not Subdivided

When said document is not subdivided by chapters or sections it may be defined as constituting a section and thereby all pages of the document are placed in a single tabbed section file folder. When placed into a file box with a plurality of other uniquely identified documents, this recapitulates the structure of the said journal and when a plurality of said boxes are grouped together this recapitulates the structure of said journal system. Thereby, the section, page, and record identifiers are uniquely defined and may be concatenated together according to the methodology defined for said journal system identifiers to create a plurality of compound identifiers.

Internal Documents Subdivided

A document subdivided by chapters may be defined as constituting a journal as defined herein above and thereby all pages of the document are placed in at least a single file box to the exclusion of all other documents. Said document may also be bound to create a book or three-hole punched and placed in a journal as defined herein above in FIG. 5. Each chapter is assigned an identifier as defined for said journal sections defined herein above. Each page is assigned an identifier as defined for said journal section pages defined herein above. Each line of text is assigned an identifier as defined for said journal page-record defined herein above. Said structure uniquely identifies each section, page, and record allowing them to be concatenated into a unique compound identifier according to the methodology defined for said journal system identifiers herein above.

Documents Not Designed to Meet Indexing Requirements Herein Above Defined for the Journal System Presently, the organization and presentation format of most published documents has been defined outside the parameters of the indexing system herein defined. These are hereafter referred to as external documents.

External Documents not Subdivided

An external document, not subdivided by chapters or sections may be defined as constituting a page within a section and thereby identified utilizing the methodology defined herein above for pages in a journal section. A plurality of said documents may be placed in a single tabbed section file folder. Most external documents are formatted to provide a unique ordinal page number and when present may be defined as constituting a record within the document just as the document is defined to represent a page within its section. If a unique page numbering is not provided this may be assigned by printing or marking said identifiers. A plurality of uniquely identified documents placed in a plurality of tabbed section file folders which are, in turn, placed into a file box recapitulates the structure of the said journal and when a plurality of said boxes are grouped together this recapitulates the structure of said journal system. Thereby, the section, document, and page identifiers are uniquely defined and may be concatenated together according to the methodology defined for said journal system identifiers to create a plurality of compound identifiers wherein the document identifier corresponds to the journal page identifier and the document page identifier corresponds to the journal record identifier. This embodiment allows indexing to the page level which is standard for referencing quotes and ideas published in external documents.

Constructing the Unique Identifiers

In order to uniquely identify a single record in the external document the user concatenates the section, document, and page numbers into a unique identification sequence as follows:

SECTION#-DOCUMENT#-PAGE#

Therefore, page number 122 in document 16 of section 9 is written as:

9-16-122

Other identifiers may be constructed from this structure such as a section-document or document-page compound identifier. As will be shown herein, any portion of this three-part identifier may be used to index and link portions of the external documents in said system.

External Documents Subdivided

An external document, subdivided by chapters or sections may be defined as constituting a journal within the informational assembly and thereby identified utilizing the methodology defined herein above for journals. Most external documents are formatted to provide a set unique ordinal chapter or section numbers that do not repeat. If a unique chapter/section numbering is not provided this may be assigned by printing or marking said identifiers. Most external documents are formatted to provide a set unique ordinal page numbers that do not repeat within each chapter or section. If a unique page numbering is not provided this may be assigned by printing or marking said identifiers. External documents are not formatted to provide line index numbers and linking entry fields. Therefore, where needed for linking these may be stamped, printed, or otherwise marked in the right and left hand margins. Additionally, a block of text may be highlighted or otherwise marked and assigned a unique record number with linking fields. Thereby, the section, page, and record identifiers are uniquely defined and may be concatenated together according to the methodology defined for said journal system identifiers to create a plurality of compound identifiers. This embodiment allows indexing to the text line or block level which is above the standard for referencing quotes and ideas published in external documents.

Constructing the Unique Identifiers

In order to uniquely identify a single text block in the external document the user concatenates the section, page, and block numbers into a unique identification sequence as follows:

CHAPTER#-PAGE#-BLOCK#

Therefore, block number 2 on page 96 of chapter 6 is written as:

6-96-2

Other identifiers may be constructed from this structure such as a chapter-page or page-block compound identifier. As will be shown herein, any portion of this three-part identifier may be used to index and link portions of the external documents in said system.

In the case where more than one file box is used to constitute a document system, each record is uniquely identified across the entire system of file boxes by one of two implementations of the system of hierarchical identifiers. Either a four-part compound identifier is constructed from the file box, section, page, and record indicia or, the section identifiers are defined as a single set of whole numbers for all file boxes in the system whereby the three-part compound identifier defined herein above defines the uniqueness of each record. The unique identifier may be extended to include releasably bound journals, file boxes, and bound books. If needed multiple journals, file boxes, and books may be integrated together by prefixing their said unique indicum to said three-part indicia defined herein above.

The Linking Method: Creating a Record Structure That Provides or Linking Records, Pages, and Sections As illustrated in FIGS. 7 and 10 each entry record in the assembly of informational items is provided with three linking fields (729 and 1029) labeled S to indicate section, P to indicate page, and R to indicate record. Entering one or more parts of the above said three part identifier from another entry, page, and/or section, each into its respective linking field, creates a connection between two informational items within an assembly of informational items. To accommodate externally generated documents each document and/or document page may be stamped or otherwise labeled with a plurality of said S, P, and R linking fields each corresponding to one of the three parts of the compound section-document-page or chapter-page-block identifier. Entering one or more parts of this three part identifier from another entry, page, and/or section, each into its respective field, creates a connection between two informational items within an assembly of informational items. Below are illustrated a plurality of generalized, non-inclusive linking cases accommodated in an embodiment of the present invention.

One-to-one linking of two records on two separate pages: FIG. 11

In an embodiment of the present invention, shown in the upper right of FIG. 11 is a partial view of a page-record (1101*a*) with PRO header (1111*a*) with a title field (1112*a*) containing the entry "LINK-FROM" in the left side of the PRO header (1111*a*). On the right hand side there are the section label (1113*a*) with preprinted section (1114*a*) and page (1115*a*) fields containing the identifiers "10" and "15" respectfully. Beneath the PRO header the first five records in a TRO (1121*a*) are shown with five columns identified by a table header (1122*a*). The left-hand column (1123*a*) contains preprinted record index numbers and the ENTRY column (1124*a*) to the right shows some of the fields containing hand marked information. One record in the TRO also has hand-marked numbers entered in the S, P, and R linking fields (1129*a*).

In an embodiment of the present invention, shown in the lower left of FIG. 11 is a partial view of another page-record (1101*b*) with PRO header (1111*b*) with a title field (1112*b*) containing the entry "LINK-TO" in the left side of the PRO header (1111*b*). On the right hand side there are the section label (1113*b*) with preprinted section (1114*b*) and page (1115*b*) fields containing the identifiers "8" and "18" respectfully. Beneath the PRO header the first five records in a TRO (1121*b*) are shown with five columns identified by a table header (1122*b*). The left-hand column (1123*b*) contains preprinted record index numbers and the ENTRY column (1124*b*) shows some of the fields containing hand marked information. The linkage of record 3 of page 18 in section 8 to record 4 of page 15 in section 10 is shown schematically by three arrowhead lines (1131,1132,1133) connecting each hand marked entry in fields S, P, and R (1129*a*) in record 4 of page 15, section 10 to the three preprinted section (1114*b*), page (1115*b*), and record (1123*b*) identifiers of record 3, page 18, section 8. Once 8 is entered into the section field, 18 is entered into the page field, and 3 is entered into the record field, the user may return to page 15 of section 10 at any future date and, by reading the contents of these fields in record 4 move directly to section 8, page 18, record 3 to access the entry linked to this one. This type of linking is called one-to-one linking.

Since all indicia are preprinted there is no need to remember any numbers or generate index numbers manually at the time of entry. Also, linking is optional and can be done at any future time between two independently entered records of information. In addition, the actual sequence number of the section, page, or record does not limit the linking methodology. This means that the entry in record 2 of page 15, section 10 can be linked to record 5 of page 18, section 8 by entering 5 into the S field, 18 into the P field, and 5 into the record field of record 2 on page 15 of section 10. It should be further evident that a link may be made between records on the same page. This may be done by two separate methods. The link may be made by entering that page's section and page number into the S and P fields of the link-from record and the record number of the link-to record into the R field of the link-from record. Alternately the S and P fields in the link-from record may be left empty and only the R field completed to indicate that the present section and page are the link-to entries.

The following FIGS. 12 through 16 inclusive use a plurality of partial views of two or more page-records structured to be similar to those defined in FIG. 11 above. To avoid clutter and confusion only one of said partial views is labeled with reference numbers corresponding to the link-from table in FIG. 11 above. In addition, section, page, and record numbers are used as reference numbers to avoid confusion. Finally, all links herein below are indicated by a single dashed and arrowhead line connecting one record to another but imply the utilization of one or more of the three linking fields as necessary to make the link work.

One-to-one linking of records to a plurality of pages of records: FIG. 12

In an embodiment of the present invention, shown in the upper left of the figure is a partial view of the link-from page-record (1201) with hand marked entries in records 1 through 4 inclusive. There are entries in the linking fields (1229) of records 1, 3, and 4. Shown to the right in the figure are partial views of two more page-records one from section 8 page 18 and one from section 5, page 89 as indicated by their section and page fields. Three separate one-to-one links are shown. The first (1231) shows record 1 of page 15 of section 10 linked to record 3 of page 18 of section 8. The second (1232) shows record 3 of page 15 of section 10 linked to record 1 of page 18 of section 8. The third shows record 4 of page 15 of section 10 linked to record 5 of page 89 of section 5. One-to-one linking between pairs of records allows a plurality of pages to be linked together.

One-to-many linking of individual records to a plurality of unspecified records located on a plurality of pages: FIG. 13

In an embodiment of the present invention, shown in the upper left of the figure is a partial view of the link-from page-record (1301) with hand marked entries in records 1 through 4 inclusive. There are entries in the linking fields (1329) of records 1 and 4. Shown to the right in the figure is a partial view of another page-record from section 8 page 18. A one-to-many link (1331) is shown by a plurality of arrowhead lines extending from record 1 of page 15 of section 10 to all of the records in page 18 of section 8.

To achieve the one-to-many linking, the R field is left empty to indicate that the entire page of records is being linked to by the link-from record. This methodology may be extended to link a record to a plurality of pages in a section by leaving the P field empty. In addition to linking from a single record to a page of records, the figure shows that, simultaneously a one-to-one link onto a single record in the same page (1332) may be made whereby record 4 of page 15 of section 15 is linked to record 5 of page 8 of section 18. Also, record 4 of page 18 of section 8 is empty. If, at a later date, data is entered into said record it would automatically be linked to record 1 of page 15 of section 10 without requiring any further action be taken.

One-to-many linking of records to a plurality of specified records: FIG. 14.

In an embodiment of the present invention, shown in the upper left of the figure is a partial view of the link-from page-record (1401) with hand marked entries in records 1 through 3 inclusive. There are entries in the linking fields (1429) of records 1,2 and 3. Shown in the ENTRY field of records 2 and 3 are dashed lines to represent continuation symbols. Shown to the right in the figure are partial views of three page-records one from section 8, page 18, one from section 12, page 21 and one from section 23, page 37. Three separate one-to-one links are shown. The first, (1431) is a link-from record 1 of page 15 of section 10 to record 1 of page 18 of section 8. The second, (1432) is a link-from record 1 via record 2 of page 15 of section 10 to record to record 5, page 21, section 12 . The third, (1433) is a link-from record 1 via record 3 of page 15 of section 10 to record 3 of page 37 of section 23. This creates a one-to-many link between a plurality of specified records. In this case the user takes two or more sequential records in the link-from page and uses each record's S, P, and R field to point to specific records elsewhere.

By leaving the R field blank in one or more of these continuation records a plurality of specified records may be linked to on the indicated page. By leaving both the P and R fields empty a plurality of specified pages in a section may be linked to.

Chain linking and recursive linking of records: FIG. 15

In an embodiment of the present invention, shown in the upper left of the figure is a partial view of the link-from page-record (1501) with one hand marked entry in record 1. There are entries in the linking fields **(1529*a*) of the record. Shown to the right in the figure is a partial view of page-record 18 of section 8 with two hand marked entries in records 2 and 3. There are entries in the linking fields (1529*b*) of record 3. Beneath these two page-records is a third partial view of page-record 35 of section 12 with one hand marked entry in record 2. There are entries in the linking fields (1529*c*). Three separate one-to-one links are shown. The first, (1531) is a link-from record 1 of page 15 of section 10 to record 3 of page 18 of section 8. The second (1532) is a link-from record 3 of page 18 of section 8 to record 2 of page 35 of section 12. The third (1533)** is a link-from record 2 of page 35 of section 12 back to record 1 of page 15 of section 10. This figure illustrates chain linking between a series of records in the journal. The number of records in the chain is only limited by the number of records in the journal.

This illustration shows that the linking may be circular leading back to the original link-from record. This is called recursive linking. Recursive linking may also be made between two records by entering their respective section, page and record numbers into the S, P, and R fields of the other record. By leaving the R field blank a one-to-many recursive link may be made between a record and a page of records. By leaving both the R and P fields blank, the recursive linking may be made between a record and a section of pages. This allows a many-to-many linking of records, pages, and sections.

Many-to-one linking of records: FIG. 16

In an embodiment of the present invention, shown in the upper left of the figure is a partial view of a link-from page-record (1601) with hand marked entries in records 1,2, and 4. There are entries in the linking fields **(1629*a*) of record 1. Shown below the first link-from page-record is a second link-from page-record 35 of section 12 with a hand marked entry in record 4. There are entries in the linking fields (1629*b*) of the record. Shown to the right in the figure is a partial view of link-to page-record 18 from section 8. Two separate one-to-one links are shown. The first, (1631) is a link-from record 1 of page 15 of section 10 to record 3 of page 18 of section 8. The second (1632)** is a link-from record 4 of page 35 of section 12 to record 3 of page 18 of section 8. This method allows a many-to-one linking between a plurality of specified records to a single specified record.

By leaving the R field empty in the link-from record this method may be generalized to allow a plurality of specified records to be linked to a plurality of unspecified records in a single page. By leaving the P and R fields empty a plurality of specified records may be linked to a plurality of unspecified pages in a specified section.

Using a plurality of linking methods to create complex compound documents: FIG. 17

In an embodiment of the present invention, shown is a schematic representation of a plurality of links between a plurality of records within a journal. At the top is a record (1701) from which two links are shown. The first link (1731) is a one-to-one and the second link (1732) is also a one-to-one. These two links together constitute a one-to-many linking. Below this the one-to-many link (1733) and the link (1732) constitute a many-to-one link onto Section 03, Page 8. Links (1734) show two simple one-to-one links. Link (1735) constitutes a recursive link between a page and a record while this link with links (1736) constitutes a circular link. Additional circular links are completed by the links (1737) and (1738).

An example of an embodiment in a working model—The Integrated Systems Management Journal In an embodiment of the invention the Integrated Systems Management Journal consists of three predefined, preprinted sections each containing a unique set of single page forms to maintain clarity. The three forms are described and then the marked entries shown in Preston script type face are reviewed to show the application of the index system and linking methodology to an actual real world situation. The present example in no way limits the number of sections, forms, pages in forms, or objects positioned on pages.

Daily Scheduler Form: FIG. 18

In an embodiment of the present invention, the Daily Scheduler consists of a plurality of pages (1801) the figure showing one of two printable and markable surfaces (1803) manufactured, cut, or folded to fit into the rectilinear space defined by the journal spine and panels. Each sheet is punched with a plurality of holes (1802) near one vertical margin allowing it to be placed on the journal rings. Each page of each Daily Scheduler has a standardized set of preprinted labels and entry fields placed on its surface. These consist of the following:

PRO header (1811) consisting of preprinted section title (1812) "DAILY SCHEDULER" in the upper corner nearest the hole punched margin with a preprinted section label (1813), section field value of "02" (1814), and page field value of "275" (1815) preprinted in the upper corner opposite the hole punched margin. Centered below these fields is an unlabeled preprinted date and day of week field value of "THURSDAY 02 OCTOBER 1997" (1820).

PRO footer (1816) consisting of a centrally located set of fields defining the form version and date of creation (1817), with duplicate form section field and page field (1818). At the bottom right-hand corner of the page are a set of preprinted fields (1819) without labels which provides the user with information About the form.

An hybrid TRO (1821) made up of two similar tables is printed in the center of the page with table header (1822) defining eight fields for the first 25 records. The left-hand column (1823) defines the index of each record in the tables by a continuous sequence of unique and ordered whole numbers preprinted in each field. To the immediate right is a "TIME" column (1824) with a plurality of preprinted hourly entries. To the right of this column are three entry fields labeled "APPOINTMENT" (1825), "DESCRIPTION" (1826), "PHONE" (1827) in order from left to right. The next three columns (1829) are labeled "S", "P", and "R" representing the section link field, page link field, and record link field respectfully. In the "TIME" column there is the "NOTE" entry redesignating records 26 through 36 as a set of free-form note fields.

Planning, Progress, & Analysis form: FIG. 19

In an embodiment of the present invention, the Planning, Progress, & Analysis Form consists of a plurality of pages (1901) the figure showing one of two printable and markable surfaces (1903) manufactured, cut, or folded to fit into the rectilinear space defined by the journal spine and panels. Each sheet is punched with a plurality of holes (1902) near one vertical margin allowing it to be placed on the journal rings. Each page of each Planning, Progress, & Analysis Form has a standardized set of preprinted labels and entry fields placed on its surface. These consist of the following:

PRO header (1911) consisting of preprinted section title (1912) "PLANNING, PROGRESS, & ANALYSIS FORM" in the upper corner nearest the hole punched margin with a pre-assigned section label (1913), section field value of "03" (1914), and pre-assigned page field value of "19" (1915) printed in the upper corner opposite the hole punched margin. Centered below these fields is an unlabeled preprinted status field (1920) assigned the value "CONFIDENTIAL".

PRO footer (1916) consisting of a centrally located set of fields defining the form version and date of creation (1917), with duplicate form section field and page field (1918). At the bottom right-hand corner of the page are a set of preprinted fields (1919) without labels which provides the user with information About the form.

A TRO (1921) is printed in the center of the page with table header (1922) defining twenty-two fields with 36 records. The left-hand column (1923) defines the index of each record in the table by a continuous sequence of unique and ordered whole numbers preprinted in each field. To the immediate right is a "TIME/DATE" column (1924). To the right of this column are 15 unlabeled, empty entry fields (1924) printed so that the vertical and horizontal dimensions of each field defined by the row and column lines represents a square. Continuous text, tabular information, charts, graphs, and drawings may be entered into and across each field and record in the present implementation using the squares as orthographic positioning and measurement indicators where required. The next three columns (1929) are labeled "S", "P", and "R" representing the section link field, page link field, and record link field respectfully.

Phone & Address Log Form: FIG. 20

In an embodiment of the present invention, the Phone & Address Log consists of a plurality of pages (2001) the figure showing one of two printable and markable surfaces (2003) manufactured, cut, or folded to fit into the rectilinear space defined by the journal spine and panels. Each sheet is punched with a plurality of holes (2002) near one vertical margin allowing it to be placed on the journal rings. Each page of each Phone & Address Log has a standardized set of preprinted labels and entry fields placed on its surface. These consist of the following:

PRO header (2011) consisting of preprinted section title (2012) "PHONE & ADDRESS LOG" in the upper corner nearest the hole punched margin with a preprinted section label (2013), pre-assigned section field value of "06" (2014), and pre-assigned page field value of "1" (2015) printed in the upper corner opposite the hole punched margin. Centered below these fields is an unlabeled entry field (2020) with a capital "A" marked to indicate this page of entries has last names starting with "A".

PRO footer (2016) consisting of a centrally located set of fields defining the form version and date of creation (2017), with duplicate form section field and page field (2018). At the bottom right-hand corner of the page are a set of preprinted fields (2019) without labels which provides the user with information About the form.

An hybrid TRO (2021) containing a plurality of MCO's each consisting of a plurality of entry fields organized into two columns of labels (2024,2026), each label identifying an entry field in one of two columns (2025,2027) positioned to the immediate right of each label column. An additional table header (2022) specifying the category of information that goes into each entry column In the upper left-hand corner of each MCO is a preprinted record index field (2023) ordering it on the page. In the upper right-hand corner of each MCO is a set of fields (2029) labeled "S", "P" and "R" representing the section link field, page link field, and record link field respectfully. Description of the journal entries and their links. Described herein below are the manual entries indicated by Preston Script type-face. Section, page, and record indica are used as reference numbers to maintain clarity and all textual entries are self referencing.

10:00 AM Entry:

On October 2, 1997 a call is received From a Mr. Anderson at 10:00 AM. This is documented in record 9 of page 275 of section 2: Daily Scheduling (1801) in the appointment field (1825), description field (1826) and phone field (1827). During the call extensive pricing information is discussed which is too much to enter into that one line record. This overflow information is entered into records 10 through 18 of page 19 in section 3: Planning, Progress, & Analysis (1901) in the notes field (1924). A link-to this entry is established by entering 3-19-10 into the S-P-R fields of record 9 of page 275 of section 2 (1829). At the end of the phone call Mr. Anderson provides his address and phone numbers. These are entered into record 1 on page 1 of section 6: Phone & Address Log (2001) "NAME & ADDRESS" fields (2025) and "AREA—PHONE" fields (2026). A link-to this entry is made by adding a record to the pricing information in section 3 (1901) called Phone & Address and entering 6-1-1 into the S-P-R fields to its immediate right (1929). Another link-from the pricing information is made back to the scheduler entry by adding another record to the pricing entry called Initial Call and entering 2-275-9 into the S-P-R fields to its immediate right (1929). Finally, The Alphabetized phone and address entry is linked back to the original scheduler entry by entering this same compound identifier 2-275-9 into its own S-P-R fields (2029).

Retrieval:

Later, when it is necessary to follow up on the initial quotes and negotiate a final contract for services this information may be accessed through multiple entry points in the journal (501). For example, if the time and date of the talk can be remembered, then the initial entry in the scheduler (1801) may be referenced in record 9 on page 275 of section 2. The link-to the price quote may be found by looking at the S-P-R linking fields (1829) where the compound identifier 3-19-10 can be seen and turning to section 3, page 19, record 10 (1901). If the time and date cannot be remembered then the name of the contractor may be looked up in the alphabetical phone and address section (2001) and the linking identifier 2-275-9 used to turn to section 2, page 275, record 9 (1801) wherein the link may be further followed via its linking fields (1829) to the quote in section 3 page 19 record 10 (1901). If the time, date, and name of the contractor cannot be remembered, then section 3 may be reviewed for an entry referring to price quotes for the custom furniture. Once found, this record links to both the scheduler (1801) and the phone and address entries (2001) are present so that these may be easily accessed.

4:30 PM Entry:

A later call is received at 4:30 PM From a Mr. Arnall with AM Best Advertising. An entry is started in record 22 on page 275 in section 2 (1801). Initially, an overflow note is entered on the same page below starting at record 26. This is linked-to from the initial entry by entering 2-275-26 into the S-P-R fields of the 4:30 PM entry. Soon it becomes evident that much more space is needed to complete the note so another entry is started in record 1 on page 19 of section 3 (1901) where an outline of an advertising campaign is listed. This expanded note is linked to the initial note by entering 3-19-1 into its S-P-R linking fields. Then the advertiser's phone and address are entered into record 2 on page 1 of section 6 (2001) which is linked via its compound identifier 6-1-2 to the immediate right of the first line of the overflow note on page 19 of section 3. In addition, this phone and address entry is linked to the initial 4:30 PM scheduler entry by entering 2-275-22 into its S-P-R linking fields.

Retrieval:

In this case retrieval is similarly enhanced by the fact that the information sought may be found by checking chronological entries in the scheduler (1801), alphabetic entries in the phone and address section (2001), or searching for the planning information in section 3 (1901). In each case the other information is immediately available via the links established at the time of the phone call.

Although a date and time is entered to the left of the entries in section 3 (1901) this is not necessary since it is referenced in the scheduler (1801) and is only shown to highlight the fact that entries into this section need not be in chronological order for this order to be maintained by the journal system. To see this is so, observe that the entry starting in record 1 on page 19 in section 3 (1901) has a later time (4:30 PM) than the entry starting in record 10 (10:00 AM). Since each record is linked to a chronological entry in the scheduler (1801), the order is maintained by the pre-assigned chronological order of the scheduler.

Further indexing:

Finally, important information may be indexed by entering a description into the TRO printed on the tabbed section divider (601) which shows a listing of entries marked with their link into the section. Since these entries are all in section 3 the entries in the S field are optional and could be left out without breaking the link. In this example, the first entry is "Cabinetry Project for Office" which, via the 3-19-10 S-P-R entry (629) links directly to the cost information and, via that entry, on to the scheduling and phone/address data elsewhere in the journal.

System Integration—The Logic

As will be evident from the disclosure of the invention, the journal and document systems may be combined into a single assembly of informational items. There is a plurality of possible implementations to achieve this end.

One embodiment of the present invention utilizes a single sequence of unique identifiers for the journals, file boxes, and bound materials. This identifier may be prefixed to the section identifier. This prefix uniquely identifies every section, document, page, and record across every journal, file box, and bound item in the assembly of informational items. This provides the capacity to inter-link journal and document records, pages, and sections together to create a complex set of logical relationships. This embodiment is particularly useful in linking between journals and files containing yearly scheduling, activity, and financial accounting reports. Each journal may be assigned an identifier incorporating the last two digits of its year. Linking outside a journal's year may then be accomplished by prefixing the section identifier with the two digit year number. The only significant deficiency of this embodiment is that a fourth identifier must be added to maintain the uniqueness of each system entry.

Another embodiment of the present invention uses a single sequence of unique indicia for each section across all journals, file boxes, and documents in the assembly of informational items. This removes the need to add a fourth part to the compound identifier and greatly simplifies the addition of informational items to the system while reducing the amount of work necessary to search for, retrieve and link that item in the future. The only significant deficiency of this embodiment is that externally generated documents which are bound must be assigned new identifiers and some journals, file boxes, and/or bound items may contain a plurality of sections identified by a noncontiguous sequence of otherwise unique indicia.

Physical Integration—The Physical System and Method

The index system defined herein above provides the means to physically integrate items in the assembly. This is achieved by standardizing the physical dimensions of the journals, file boxes, tabbed section dividers, tabbed file folders, page-records, document pages, and bound pages so that tabbed dividers and pages from journal forms will fit into file holders and tabbed file folders and pages from file documents fit into journals. To further achieve this end, the tabbed section file folders and file documents can be punched using the same plurality and spacing of holes as the tabbed section dividers and page-records in the journal allowing the user to physically integrate the journal and document system. A plurality of tabbed section dividers and said pages may be removed from the journal and placed into a plurality of file boxes. A plurality of tabbed section file folders and said documents may be removed from the file box, the documents then removed from the folder and positioned behind it, this assembly then placed into a journal. Forms and documents may be assembled together in a section within either a journal or file box when the uniqueness of their compound identifiers are maintained by one of the present embodiment described herein above. These may subsequently be moved together between the two systems or disassembled and stored in separate sites while maintaining the original indexing and linking information.

Physical Integration of Forms and External Documents into a Journal: FIG. 21

In an embodiment of the present invention, a plurality of forms (2101) are grouped together (2131) in sequential order determined by section-page identifiers. A plurality of documents (2108) are grouped together (2132) in sequential order determined by section (2114) and document (2115) identifiers. In this embodiment of the present invention the page-record and document identifiers are generated from a single sequence of unique whole numbers. This allows the grouping of forms and documents together in sequential order determined by their respective section-page and section-document identifiers and their placement (2133, 2134) behind the tabbed section divider (2109) identified by the same section identifier as the forms and documents. This section of forms and documents is placed (2135) on the metal rings of the releasable journal (2141) with the section placed in sequential order within the journal determined by its identifier.

Physical Integration of Forms and External Documents into a File Box: FIG. 22

In an embodiment of the present invention, a plurality of forms (2201) are grouped together (2231) in sequential order determined by its section-page identifier. A plurality of documents (2208) are grouped together (2132) in sequential order determined by the section (2214) and document (2215) identifiers. In this embodiment of the present invention, the page-record and document identifiers are generated from a single sequence of unique whole numbers. This allows the grouping of forms and documents together in sequential order determined by their respective section-page and section-document identifiers and their placement (2233, 2234) in the tabbed section file folder (2209) with the same section identifier as the forms and documents. This section of forms and documents is placed (2235) in the file box (2241) with the section placed in sequential order within the box determined by its identifier. In addition, this box may be placed into an hanging file holder (2242) so as to be placed in an hanging file drawer (see FIG. 23 below).

A Plurality of Journals and File Boxes comprising an Informational Assembly: FIG. 23

In an embodiment of the present invention, a plurality of journals (2342) are shown stored in an upright position on a plurality of shelves (2341). In this embodiment, the journals are ordered by a unique single character identifier (2343) marked or printed on the spine so that it is easily seen by the user. A plurality of file boxes (2346) are shown stored in an upright position in a plurality of file cabinet drawers (2345) in a file cabinet (2344), one of which is shown open to expose its contents. The file boxes are ordered by a unique single character identifier marked or printed on the tab of said file box (2346) so that it is easily seen by the user. This identifier may be different or the same as those marked on the journals. By making them the same, contents of the journal may be moved to the file box (2331) and contents of the file box may be moved to the journal (2332). By manufacturing the journals so that they fit within the rectilinear space defined by the file box, the entire journal may be stored in the file box allowing for further physical integration of the journal and document systems by allowing for simultaneous storage of a plurality of bound and unbound documents side-by-side with journals in a comprehensive hanging file folder cabinet system.

Creating an automated version of the Indexing System and Linking Methodology That Allows the Assembly of Informational Items to be Manipulated by Software Programs.

An assembly of informational items stored and organized on a paper-based system may also be entered or created and then stored in part or as a whole on electronic-based media as an hierarchy of tables, records, and fields. Said assembly of informational items may be displayed in forms on a video monitor screen as part of an automated, computerized database system as well as printed out to incorporate into said paper-based system. Said hierarchically organized electronic-based assembly of informational items with its indexing and linking data may be manipulated by a large number of commercially available software programs or by customized programs. Said hierarchy provides for an electronic-based system of journals, file boxes, sections, documents, pages, entry records, items, and text blocks.

A Flat File Model to Store Index and Linking Data Informational Assembly: FIG. 24

In an embodiment of the present invention, a master indexing table may be defined in almost any commercially available database development software program as a relational table stored on electronic-based media. Shown is a partial view of a tabular listing **(2401*a*) of short descriptions of each informational record in the paper-based journal system illustrated in FIGS. 18, 19, and 20 herein above. Said descriptions are entered in the field defined by the fourth column (2405) labeled RECORD ENTRY DESCRIPTION and are referred to as item descriptors herein below. To the left of said column (2405)** are three more columns labeled S'

(2402), P' (2403), AND R' (2404). The S' field (2402) stores said item's paper-based section identifier, the P' field (2403) said item's paper-based page identifier, and the R' field (2404) stores said item's paper-based record identifier. To the right of said item descriptor column (2405) are three more columns labeled S (2406), P (2407), and R (2408). The S field (2406) stores said item's paper-based section linking entry, the field (2407) said item's paper-based page linking entry, and the R field (2408) stores said item's paper-based record linking entry. If there are entries in one or more of these three fields in the paper-based informational record, then they may be entered into said three linking fields in identical order. Once an item descriptor has been located in the electronic-based index table (2401*a*) its paper-based entry may be located by using the entries in the S' (2402), P' (2403), AND R' (2404) fields. In addition, any entries in said descriptor's S (2406), P (2407), and R (2408) fields may be used to locate the link-to informational record in the paper-based system or to locate said record's descriptor in the electronic-based index table.

Once a plurality of said indexing records are entered with their indexing and linking indicia the tabular listing thus created (2401*a*) may be manipulated by interaction via a commercially available software program or by the creation of custom software programs using a variety of commercially available database programming languages. For example, as show, the master indexing table (2401*a*) is initially sorted by the S' (2402), P' (2403), AND R' (2404) fields in hierarchical order, first by the contents of the S' field (2402), then by the contents of the P' field (2403), and finally by the contents of the R' (2404). Executing a sort procedure (2409) in said program causes the descriptor records to be reordered as an alphabetical listing (2401*b*). It will be apparent to those skilled in the art that the tabular listing of descriptors (2401*a*, 2401*b*) may be sorted by the contents of the S (2406), P (2407), and R (2408) fields and then any group of linked records extracted for viewing as a group of related entries in the assembly of informational items. Said application of programming logic allows for the graphic presentation of an hierarchy of informational items and their links much like that shown herein above in FIG. 17. Once created, all or a part of the indexing table's (2401*a*) contents and said views may be printed as reports via commercially available printers and included with the paper-based system to provide a variety of enhancements to its use.

An Example Data Model to Store All of the Informational Assembly

Since the paper-based structure of the informational divisions is highly organized around the concept of an hierarchy of tables represented physically by tabbed dividers, page-records, and preprinted forms with TRO's and MCO's, the creation of a fully automated assembly of informational items stored, accessed, and manipulated on a computer is facilitated. Presented herein below is an example data structure defined as relational tables stored on electronic-based media that provides those skilled in the art with the necessary information to create a data dictionary in a plurality of commercially available database programs.

Example Registration Database to Define the Structure of the Informational Divisions: FIG. 25

In an embodiment of the present invention, a set of three electronic-based relational tables are defined to hold information about the hierarchy of informational divisions and provide the means for duplicating the structural relationship between form-page, page-record, and design objects used in creating the paper-based system.

The first table (2501) is the Section Table, a partial view being shown. It contains a column (2502) labeled S' that defines a field for storing the paper-based section identifier, a column (2505) labeled SECTION NAME that defines a field for storing the section title, a column (2506) labeled FP that defines a field for storing the number of pages in the form ordered by said section, and a column (2507) that defines an incrementing field for storing the number of pages existing in said section. Said table is indexed and ordered by the Section Identifier field (2502) as shown.

The second table (2511) is the Page Registration Table, a partial view being shown. It contains a column (2512) labeled S' that defines a field for storing the paper-based section identifier, a column (2513) labeled F' that defines a field for storing a unique indicum for each page included in a section's multi-page form, column (2515) labeled PAGE NAME that defines a field for storing the name of said page in its form, a column (2516) labeled VERSION that defines a field for storing the present version of said page design, and a column (2517) labeled PT that defines a field for storing the number of TRO's and MCO's positioned on said page's surface. The version field (2516) is included to illustrate how to provide a place to store predefined page display data that does not change from page-to-page within said page's section. It will be apparent to those skilled in the art that other fields may be defined for this purpose such as storing a copyright notice field, special instruction fields, and graphic image fields that may be positioned on the page along with its tabular data. Stored procedure fields that provide a means for further expanding the capabilities of the database structure beyond those provided by the paper-based system may also be included. Said table (2511) is indexed and ordered by the contents of the Section Identifier field (2512) and Form Page Identifier field (2513) as shown.

The third table (2521) is the Object Registration Table, a partial view being shown. It contains a column (2522) labeled S' that defines a field for storing the paper-based section identifier, a column (2523) labeled F' that defines a field for storing the unique identifier for a page included in a multi-page form, a column (2524) labeled T' that defines the field for storing a unique identifier for each table positioned on said page, a column (2525) labeled TABLE NAME that defines a field for storing the name of said table on said page, a column (2526) labeled TR that defines a field for storing the maximum number of records said table may have positioned on said page, and a column (2527) labeled RD that defines a field for storing the highest ordered sequential indicum that may be assigned to a record in said table when positioned on said page. Said table is indexed and ordered by the Section Identifier field (2522), Form Page Identifier field (2523), and page Table Identifier fields (2524) as shown.

The contents of the two fields labeled PAGE NAME (2515), and TABLE NAME (2525) also refer to the names of electronic-based relational tables that store the informational records of said page-records and table-records. The three tables (2501, 2511, 2521) illustrated herein above are joined according to standard one-to-many links which may be created by commercially available database development programs. The Page Registration Table (2511) is linked (2509) as a detail table to the Section Table by their identically defined Section Identifier fields (2502, 2512). An example of the linking of said records on the computer is herein below indicated by the intaglio white-on-black printing of the Daily Scheduler record in both tables and referred herein below as highlighting of the record or records. In turn, the Object Registration Table (2521) is linked (2519) as a detail table to the Page Registration Table (2511) by their identically defined Section Identifier fields (2512, 2522) and their identically defined Form Page Identifier fields (2513, 2523). Since there are two TRO's positioned on the Daily Scheduler page (1801) two records are entered into the Page Table Registration Table (2521) as indicated by the two highlighted records. The relational structure illustrated herein above thus creates an hierarchy of informational divisions which allows for a database program to access all information necessary to construct an electronic-based representation of the paper-based assembly of informational items along with their index and linking data. In addition, said structure allows for the accessing and processing of said data in order to automate indexing, linking, and locating a plurality of informational items. It will be apparent to those skilled in the art that a plurality of forms may be assigned to any section in the electronic-based system by creating another relational table named Form Registration Table interposed between the Section Table (2501) and the Page Registration Table (2511) that would allow for the entry of multiple records linked to any one record entry in the Section Table (2501) such that each said entry in the Form Registration Table would represent a different form with said section. In turn, each record in the Page Registration Table (2511) would now represent a page within said form.

Example Set of Relational Tables to Define the Contents, Indexes, and Linking Data of the Informational Divisions Illustrated in FIG. 18 and 19 herein above: FIG. 26

In an embodiment of the present invention, a set of five data tables are presented to illustrate how an assembly of informational items may be stored on electronic-based media while maintaining all indexing and linking data as defined for the paper-based system.

The first table (2501) is identical to that described in FIG. 25 herein above.

The second table (2601) is an example of one of a plurality of page-record tables defined to store variable informational items for a specific page in a form, a partial view of the Daily Scheduler Page (1801) being shown. Said table contains a column (2602) labeled S' that defines a field for storing the paper-based section identifier, a column (2603) labeled P' that defines a field for storing the page number, and a column (2605) labeled DATEFIELD that defines a field for storing the date represented by each page in the scheduler. Said table is indexed and ordered by the Section Identifier field (2602) and Page Number field (2603) as shown.

The third table (2611) stores informational entries from first TRO highlighted in the Object Registration Table (2521) illustrated herein above in FIG. 25, a partial view of the Scheduling TRO illustrated in FIG. 18 being shown. Said table contains a set of three indexing fields labeled S' (2612), P' (2612), and R' (2614) that correspond to the S' (2402), P' (2403), and R' (2404) fields defined herein above in FIG. 24. Said table contains additional informational fields including a column (2615*a*) labeled TIME that defines a field for storing the time, a column (2615*b*) labeled APPOINTMENT that defines a field for storing appointment information, a column (2615*c*) labeled DESCRIPTION that defines a field for storing additional descriptive information, and a column (2615*d*) labeled PHONE that defines a field for storing a phone number. Said table also contains a set of three linking fields labeled S (2616), P (2617), and R (2618) that correspond to the S (2406), P (2407), and R (2408) fields defined herein above in FIG. 24.

The fourth table (2621) stores informational entries from second TRO highlighted in the Object Registration Table (2521) illustrated herein above in FIG. 25, a partial view of the Continuation Notes TRO (1801) being shown. Said table contains a set of three indexing fields labeled S' (2622), P' (2622), and R' (2624) that correspond to the S' (2402), P' (2403), and R' (2404) fields defined herein above in FIG. 24. Said table contains additional informational fields including a column (2625*a*) labeled TIME that defines a field for storing the time and a column (2625*b*) labeled NOTES that defines a field for storing additional free form text. Said table also contains a set of three linking fields labeled S (2626), P (2627), and R (2628) that correspond to the S (2406), P (2407), and R (2408) fields defined herein above in FIG. 24.

The fifth table (2611) stores informational entries from first TRO defined in the Object Registration Table (2521) for section 3, Planning, Progress, & Analysis illustrated herein above in FIG. 25, a partial view of the Planning & Progress TRO (1901) being shown. Said table contains a set of three indexing fields labeled S' (2632), P' (2632), and R' (2634) that correspond to the S' (2402), P' (2403), and R' (2404) fields defined herein above in FIG. 24. Said table contains additional informational fields including a column (2635*a*) labeled T/D that defines a field for storing :he time and date and a column (2635*b*) labeled NOTES that defines a field for storing free form text and graphics. Said table also contains a set of three linking fields labeled S (2636), P (2637), and R (2638) that correspond to the S (2406), P (2407), and R (2408) fields defined herein above in FIG. 24.

The five data tables are related according to standard one-to-many links which may be created by commercially available database development programs. This includes a master-detail link (2609) from the Section Table (2501) to the Page-Record Table (2601) by their respective section identifier fields (2502, 2602) and a master-detail link (2619) from the Page-Record Table to the Scheduling Table (26011) by their respective section identifier fields (2602, 2612) and page number fields (2603, 2613). When the Daily Scheduler record in the Section Table (2501) is highlighted, all pages defined for that section are displayed in the Daily Scheduler Page-Record Table (2601). When the 02 OCTOBER 1997 record in said Page-Record Table (2601) is highlighted all records in the Daily Scheduler TRO (2611) for that day are displayed. This same one-to-many link is also made between the Daily Scheduling Page-Record Table (2611) and the Continuation Data Table (2621) (not shown for clarity).

Additional one-to-many relational links are defined between each Object Table such that, for example (2629), where the S field (2616) in the Scheduling Table (2611) links to the S' field (2622) in the Continuation Table (2621), the P field (2617) in the Scheduling Table (2611) links to the P' field (2623) in the Continuation Table (2621), and R field (2618) in the Scheduling Table (2611) links to the R' field (2624) in the Continuation Table (2621). In the same way the Continuation Data Table (2621) and Planning & Progress Data Table (2631) are linked (2639).

The above said relational structure provides the means for storing all informational items stored in a paper-based system while maintaining said paper-based indexing and linking data. In addition, the electronic-based assembly of informational items allows for both forward and backward linking between any two informational items in the assembly. This capability provides the means for finding every record in a set of linked records no matter which record is found first. In addition, said electronic-based system allows commercially available database programs to execute complex queries on the data tables to collect all linked records and display them together on one screen in a plurality of orderings including graphic display of the linking hierarchy much like that shown in FIG. 17 herein above. In addition, linking may be made automatic by highlighting one record in any TRO and drawing a link-to any other record in any other or the same TRO on screen with the database program copying the linked-to records indexing data in the link-from record automatically without the need for the keying in of said indica into their respective S, P, and R fields. Custom reports may then be printed including only those informational items linked together and excluding those not related to said compound document. A person skilled in the art will see that many other advantages are obtained by storing the informational divisional structure and informational items in an automated computer database on electronic-based media.

Summary, Ramifications, and Scope

System Flexibility and Expandability

The indexing system, record structure, and linking methodology defined herein above provides the means to create a comprehensive assembly of informational items stored on electronic-based and paper-based media. A plurality of journals, file boxes, and bound materials may be added up to the physical limits imposed by the amount of storage space available while maintaining the high degree of order established by the divisional hierarchy. A plurality of new or redesigned forms and documents consisting of a plurality of pages may be added at any time to a plurality of sectional divisions while maintaining the high degree of order established by the divisional hierarchy and previously constructed links.

There are many additional benefits provided by the present invention. Although the embodiment of the present invention shows each section containing a single form design, the page level assignment of indicia allows for a plurality of different form designs to be stored together within any one section. This flexibility allows for the creation of sophisticated, mission-specific journals and documents which provide a set of linkable entry forms and associated documents tailor made to any situation. In addition, older forms, which no longer need to be physically present in the journal, can be purged into a separate file box archive without breaking any links that have already been formed. This means that the journal may be kept at a convenient physical size while still providing access to a larger set of informational items stored elsewhere.

Computer generation of content and integration of manual and automated information New forms may be designed and filled in, and new alphanumeric textual and graphic documents may be created using a variety of commercially available word processing, spreadsheet, database, illustration, and/or multimedia software programs that may be executed on a commercially available computer. These forms and documents may be stored on electronic-based media and then displayed electronically or printed onto paper-based media with their unique identifiers positioned on the surface where easily seen by the user. Where defined, linking information may be displayed or printed into the appropriate linking fields. These computer generated forms and documents may be placed into a plurality of journals, files, and bound documents. Furthermore, manually entered textual, graphic, and symbolic information stored in the paper-based forms may be stored with its indexing and linking data on electronic-based media. This allows for the complete integration of electronic-based and paper-based storage media so that hybrid manual and automated systems may be created that allows for any degree of computer automation and, therefore, provides a smooth transition from a fully paper-based to a fully automated document handling system.

Implementing the Indexing System, Record Structure and Linking Methodology Throughout Society to Transition From the Information Age to the Knowledge Age Since most information destined to be published as forms, documents and bound items is stored on electronic-based media, the indexing system, record structure, and linking methodology defined herein above may be established as an industry standard. The resulting presentation format would provide a society-wide capability whereby any individual end user of any available informational item would be given the capability to create a comprehensive set of compound documents that facilitate the development of knowledge.

Integration of Other Objects—Inventory System

It should be clear from the above description that the indexing system and linking methodology may be extended to include an inventory of physical objects such as any assembly of collected or manufactured items such as photographs, art work, and any other thing which has a viewable and markable surface. Upon further study of the specification and appended claims, further objects and advantages of this invention will become apparent to those skilled in the art.

Other Embodiments of the Invention a brief review of the relative utility of various possible embodiments of the invention The preferred embodiment of the invention presented herein above provides a unique, three-part identifier for every entry record in the journal. The choice of this particular embodiment is based on providing the maximum utility value to the user. The three identifiers may be easily visualized from the design elements of the page-record and the compound identifier is short enough to be transcribed in one pass with little error or effort into three contiguous linking fields of the link-from page. Using three linking fields provides the user with the additional option of substituting a three part date consisting of two digit year, two digit month, and two digit day identifier such as YY-MM-DD in situations where entries to be linked to are identified by a date. In addition, if the section identifiers are kept small in size, then a journal or file prefix may be added to increase the indexing and linking capabilities without sacrificing the advantages described herein above.

Other embodiments of the invention for organizing an index that uniquely defines each entry record include:

- a sequence of records over the entire journal system—one identifier.
- a sequence of forms each containing a sequence of records—two identifiers.
- a sequence of pages each containing a sequence of records—two identifiers.
- a sequence of sections each containing a sequence of records—two identifiers.
- a sequence of sections containing a sequence of forms containing a sequence of records—three identifiers.
- a sequence of sections containing a sequence of forms containing a sequence of pages containing a sequence of records—four identifiers.
- an indexing system utilizing more than four identifiers.

A larger number of identifiers may require two or more passes before the entire number is entered and increases the possibility of error. In addition, a larger number of identifiers requires excessive amounts of space to display in linking fields leaving an inadequate amount to commit to the entry of informational items in a tabular record on standard sized 8.5" by 11" paper. A smaller number of identifiers will not provide an adequate subdivision of the informational assembly and provide too few indicia to store large numbers of entries. In addition, the flexibility of adding new records to a page, new pages to a form, new forms to a section, and new sections to a journal or file holder is greatly limited.

Although the above alternative embodiments are contemplated by the present invention, it can be seen that the preferred embodiment provides the greatest utility and flexibility at the lowest price in administrative overhead and possible error while providing unique identification for a very large number of records, pages and sections. If the length of the section identifier is limited to only two digits each in the range of 0 to 9, the page identifier to three digits each in the range of 0–9, and the record identifier to a maximum of only 30 per page then the total number of entries that could be included in a single journal would be three million records on one hundred thousand pages in one hundred sections. If alphanumeric identifiers in any combination of the alphabet (A–Z) and numbers (0–9) are used then the combination provides a total of 1,813,985,280 entries on 60,406,176 pages in 1296 sections. This is almost two billion records—adequate for most needs. Adding journal identifiers greatly increases this number. Also, in the preferred embodiment of the invention, numeric identifiers consisting of whole numbers starting with the number one (1) are used to maintain clarity and ease of use but not to limit the scope of the ideas presented. A person skilled in the art will see that decimal numbers, foreign alphabetic characters, and symbolic indicia may be utilized to enhance the capabilities of the index system and add further meaning to the indexing system and linking methodology.

What is claimed is:

1. A method of indexing and linking information which comprises the steps of:

forming at least one page of a first form type;

recording at least one first informational item on said at least one page of said first form type;

forming at least one page of a second form type;

recording at least one first alphanumeric indicum on said at least one page of at least one of said first form type and said second form type;

recording at least one second informational item on at least one page of at least one of said first form type and said second form type such that said recording assigns said at least one first alphanumeric indicum to said at least one second informational item; and recording said at least one first alphanumeric indicum on said at least one page of said first form type having said at least one first informational item recorded thereon such that a reader of said at least one first informational item and said at least one first alphanumeric indicum can link said at least one first informational item with said at least one second informational item.

2. The method of indexing and linking information as recited in claim 1, wherein said at least one second alphanumeric indicum uniquely identifies a location of said at least one second informational item to enable a reader to readily determine said location of said at least one second informational item which is linked to said at least one first informational item.

3. The method of indexing and linking information as recited in claim 1, further comprising the step of recording at least one second alphanumeric indicum on said at least one page of said first form type such that recording said at least one first informational item on said at least one page of said first form type assigns said second alphanumeric indicum to said first informational item.

4. A method of indexing and linking information which comprises the steps of:

forming at least one page of a first form type;

assigning at least one first unique alphanumeric indicum to each of a plurality of said pages of said first form type;

recording said at least one first unique alphanumeric indicum on each of a plurality of said pages of said first form type;

recording at least one second alphanumeric indicum on said at least one page of said first form type;

recording at least one first informational item on said at least one page of said first form type such that said recording assigns said at least one second alphanumeric indicum to said at least one first informational item;

forming at least one page of a second form type;

assigning at least one third unique alphanumeric indicum to each of a plurality of pages of said second form type;

recording said at least one third unique alphanumeric indicum on each of a plurality of said pages of said second form type;

recording at least one fourth alphanumeric indicum on said at least one page of said second form type;

recording at least one second informational item on said at least one page of said second form type such that said recording assigns said at least one fourth alphanumeric indicum to said at least one second informational item; and recording said fourth alphanumeric indicum assigned to said at least one second informational item and said third alphanumeric indicum assigned to said plurality of pages of said second form type on said at least one page of said first form type having said at least one first informational item recorded thereon such that a reader of said at least one first informational item and said third and fourth alphanumeric indicia can link said at least one first informational item with said at least one second informational item.

5. The method of indexing and linking information as recited in claim 4, further comprising the steps of:

forming at least one first informational division;

assigning at least one fifth unique alphanumeric indicum to each of said at least one first informational division;

placing at least one page of said at least one first form type having recorded therein said at least one first informational item within said at least one first informational division;

recording said fifth unique alphanumeric indicum assigned to said at least one first informational division on each said at least one page of said first form type;

forming at least one second informational division;

assigning at least one sixth unique alphanumeric indicum to said at least one second informational division;

placing at least one page of at least one second form type having recorded therein said at least one second informational item within said at least one second informational division;

recording said sixth unique alphanumeric indicum assigned to said at least one second informational division on each said at least one page of said second form type; and recording said fourth alphanumeric indicum assigned to said second informational item, said third alphanumeric indicum assigned to said page of said second form type, and said sixth alphanumeric indicum assigned to said second informational division on said at least one page of said first form type having said at least one first informational item recorded thereon such that a reader of said at least one first informational item and said third, fourth, and sixth alphanumeric indicia can link said at least one first informational item with said at least one second informational item.

6. A method of indexing and linking information as recited in claim 5, further comprising the steps of:

forming at least one third informational division;

assigning at least one seventh unique alphanumeric indicum to each of said at least one third informational divisions; and placing at least one of said at least one first informational division and said at least one second informational division within said at least one third informational division.

7. The method of indexing and linking information as recited in claim 5, further comprising the steps of:

forming at least one first divisional holder;

assigning at least one eighth unique alphanumeric indicum to each of said at least one first divisional holder;

placing at least one of said at least one first informational division within said at least one first divisional holder;

placing at least one page of said at least one first form type having recorded therein said at least one first informational item within said at least one first informational division;

forming at least one second divisional holder;

assigning at least one ninth unique alphanumeric indicum to said at least one second divisional holder;

placing at least one of said at least one second informational division within said at least one second divisional holder;

placing at least one page of said at least one second form type having recorded therein said at least one second informational item within said at least one second informational division;

recording said fourth alphanumeric indicum assigned to said second informational item, said third alphanumeric indicum assigned to said page of said second form type, said sixth alphanumeric indicum assigned to said second informational division, and said ninth alphanumeric indicum assigned to said second divisional holder on said at least one page of said first form type having said at least one first informational item recorded thereon such that a reader of said at least one first informational item and said third, fourth, sixth, and ninth alphanumeric indicia can link said at least one first informational item with said at least one second informational item.

8. The method of indexing and linking information as recited in claim 7, further comprising the steps of:

removing at least one of said at least one second informational division with its at least one page of said at least one second form type with its said at least one second informational item from said at least one second divisional holder;

placing at least one of said at least one second informational division with its at least one page of said at least one second form type with its said at least one second informational item into said at least one first divisional holder; and positioning said at least one second informational division with said at least one page of said at least one second form type in said at least one first divisional holder by said sixth alphanumeric indicum such that a reader of said at least one first informational item and said third, fourth, and sixth alphanumeric indicia can link said at least one first informational item with said at least one second informational item.

9. A method of indexing and linking information which comprises the steps of:

forming at least one page of a first form type;

forming at least one first table as a rectangular structure on said at least one page of said at least one first form type;

forming at least one first record as a horizontal row in said at least one first table;

forming at least one first vertical column in said at least one first table wherein at least one first entry field is formed by the intersection of said at least ore first row and said at least one first vertical column;

recording at least one first informational item in said at least one first entry field in said at least one first record in said at least one first table on said at least one page of at least one first form type;

forming at least one page of a second form type;

forming at least one second table as a rectangular structure on said at least one page of said at least one second form type;

forming at least one second record as a horizontal row in said at least one second table;

forming at least one second vertical column in said at least one second table wherein at least one second entry field is formed by the intersection of said at least one second row and said at least one second vertical column;

recording at least one first alphanumeric indicum in said at least one second entry field in said at least one second record in said at least one second table on said at least one page of at least one second form type;

forming at least one third vertical column in said at least one second table wherein at least one third entry field is formed by the intersection of said at least one second row and said at least one third vertical column;

recording at least one second informational item in said at least one third entry field in said at least one second record having recorded therein said at least one first alphanumeric indicum in said at least one second table on said at least one page of said at least one second form type wherein said recording assigns said at least one first alphanumeric indicum to said at least one second informational item;

forming at least one fourth vertical column in said at least one first table wherein at least one fourth entry field is formed by the intersection of said at least one first row and said at least one fourth vertical column; and recording said at least one first alphanumeric indicum in said at least one fourth entry field in said at least one first record having recorded therein said at least one first informational item in said at least one first table on said at least one page of said first form type such that a reader of said at least one first informational item and said at least one first alphanumeric indicum can link said at least one first informational item with said at least one second informational item.

10. A method of indexing and linking information as recited in claim 9, wherein said at least one second alphanumeric indicum uniquely identifies a location of said at least one second record in said at least one second table on said at least one page of said at least one second form type to enable a reader to readily determine said location of said at least one second informational item which is linked to said at least one first informational item.

11. A method of indexing and linking information as recited in claim 9, further comprising the steps of:

forming at least one fifth vertical column in said at least one first record in said at least one first table wherein at least one fifth entry field is formed by the intersection of said at least one first row and said at least one fifth vertical column; and recording at least one second alphanumeric indicum in said at least one fifth entry field in said at least one first record in said at least one first table on said at least one page of said first form type such that recording said at least one first informational item in said first at least one entry field in said at least one first record having recorded therein said at least one second alphanumeric indicum in said at least one first table on said at least one page of said first form type assigns said second alphanumeric indicum to said first informational item.

12. A method of indexing and linking information which comprises the steps of:

forming at least one page of a first form type;

assigning at least one first unique alphanumeric indicum to each of a plurality of said pages of said first form type;

recording said at least one first unique alphanumeric indicum on each of a plurality of said pages of said first form type;

forming at least one first table as a rectangular structure on said at least one page of said at least one first form type;

forming at least one first record as a horizontal row in said at least one first table;

forming at least one first vertical column in said at least one first table wherein at least one first entry field is formed by the intersection of said at least one first row and said at least one first vertical column;

recording at least one second alphanumeric indicum in said at least one first entry field in said at least one first record in said at least one first table on said at least one page of at least one first form type;

forming at least one second vertical column in said at least one first table wherein at least one second entry field is formed by the intersection of said at least one first row and said at least one second vertical column;

recording at least one first informational item in said at least one second entry field in said at least one first record having said at least one second alphanumeric indicum recorded therein in said at least one first table on said at least one page of at least one first form type wherein said recording assigns said at least one second alphanumeric indicum to said at least one first informational item;

forming at least one page of a second form type;

assigning at least one third unique alphanumeric indicum to each of a plurality of pages of said second form type;

recording said at least one third unique alphanumeric indicum on each of a plurality of said pages of said second form type;

forming at least one second table as a rectangular structure on said at least one page of said at least one second form type;

forming at least one second record as a horizontal row in said at least one second table;

forming at least one third vertical column in said at least one second table wherein at least one third entry field is formed by the intersection of said at least one second row and said at least one third vertical column;

recording at least one fourth alphanumeric indicum in said at least one third entry field in said at least one second record in said at least one second table on said at least one page of at least one second form type;

forming at least one fourth vertical column in said at least one second table wherein at least one fourth entry field is formed by the intersection of said at least one second row and said at least one fourth vertical column;

recording at least one second informational item in said at least one fourth entry field in said at least one second record having said at least one fourth alphanumeric indicum recorded therein in said at least one second table on said at least one page of at least one second form type wherein said recording assigns said at least one fourth alphanumeric indicum to said at least one second informational item;

forming at least one fifth vertical column in said at least one first table wherein at least one fifth entry field is formed by the intersection of said at least one first row and said at least one fifth vertical column;

forming at least one sixth vertical column in said at least one first table wherein at least one sixth entry field is formed by the intersection of said at least one first row and said at least one sixth vertical column; and recording said fourth alphanumeric indicum assigned to said at least one second informational item in said fifth entry field and said third alphanumeric indicum assigned to said plurality of pages of said second form type in said sixth entry field in said at least one first record having recorded therein said at least one first informational item in said at least one first table on said at least one page of said first form type such that a reader of said at least one first informational item and said third and fourth alphanumeric indicia can link said at least one first informational item with said at least one second informational item.

13. The method of indexing and linking information as recited in claim 12, further comprising the steps of:

forming at least one first informational division;

assigning at least one fifth unique alphanumeric indicum to each of said at least one first informational division;

placing at least one page of said at least one first form type having recorded therein said at least one first informational item within said at least one first informational division;

recording said fifth unique alphanumeric indicum assigned to said at least one first informational division on each said at least one page of said first form type; forming at least one second informational division;

assigning at least one sixth unique alphanumeric indicum to said at least one second informational division;

placing at least one page of at least one second form type having recorded therein said at least one second informational item within said at least one second informational division;

recording said sixth unique alphanumeric indicum assigned to said at least one second informational division on each said at least one page of said second form type;

forming at least one seventh vertical column in said at least one first table wherein at least one seventh entry field is formed by the intersection of said at least one first row and said at least one seventh vertical column; and recording said fourth alphanumeric indicum assigned to said at least one second informational item in said fifth entry field, said third alphanumeric indicum assigned to said plurality of pages of said second form type in said sixth entry field, and said sixth alphanumeric indicum assigned to said at least one second information division in said seventh entry field in said at least one first record having recorded therein said at least one first informational item in said at least one first table on said at least one page of said first form type such that a reader of said at least one first informational item and said third, fourth, and sixth alphanumeric indicia can link said at least one first informational item with said at least one second informational item.

14. The method of indexing and linking information comprising the steps of:

forming at least one page of a first form type;

forming at least one first table as a rectangular structure on said at least one page of said at least one first form type;

forming at least one first record as a horizontal row in said at least one first table;

forming at least one first vertical column in said at least one first table wherein at least one first entry field is formed by the intersection of said at least one first row and said at least one first vertical column;

recording at least one first informational item in said at least one first entry field in said at least one first record in said at least one first table on said at least one page of at least one first form type;

forming at least one second table on at least one first electronic-based media;

forming at least one second record as a row in said at least one second table;

forming at least one second column in said at least one second table wherein at least one second entry field is formed by the intersection of said at least one second row and said at least one second column;

recording said at least one first informational item in said at least one second entry field in said at least one second record in said at least one second table on said at least one first electronic-based media;

forming at least one page of a second form type;

forming at least one third table as a rectangular structure on said at least one page of said at least one second form type;

forming at least one third record as a horizontal row in said at least one third table;

forming at least one third vertical column in said at least one third table wherein at least one third entry field is formed by the intersection of said at least one third row and said at least one third vertical column;

recording at least one first alphanumeric indicum in said at least one third entry field in said at least one third record in said at least one third table on said at least one page of at least one second form type;

forming at least one fourth vertical column in said at least one third table wherein at least one fourth entry field is formed by the intersection of said at least one third row and said at least one fourth vertical column;

recording at least one second informational item in said at least one fourth entry field in said at least one third record having recorded therein said at least one first alphanumeric indicum in said at least one third table on said at least one page of said at least one second form type wherein said recording assigns said at least one first alphanumeric indicum to said at least one second informational item;

forming at least one fourth table on at least one of said at least one first or at least one second electronic-based media;

forming at least one fourth record as a row in said at least one fourth table;

forming at least one fifth column in said at least one fourth table wherein at least one fifth entry field is formed by the intersection of said at least one fourth row and said at least one fifth column;

recording said at least one first alphanumeric indicum in said at least one fifth entry field in said at least one fourth record in said at least one fourth table on said at least one second electronic-based media;

forming at least one sixth vertical column in said at least one fourth table wherein at least one sixth entry field is formed by the intersection of said at least one fourth row and said at least one sixth column;

recording at least one second informational item in said at least one fifth entry field in said at least one fourth record having recorded therein said at least one first alphanumeric indicum in said at least one fourth table on said at least one second electronic-based media wherein said recording assigns said at least one first alphanumeric indicum to said at least one second informational item;

forming at least one seventh vertical column in said at least one first table wherein at least one seventh entry field is formed by the intersection of said at least one first row and said at least one seventh vertical column;

recording said at least one first alphanumeric indicum in said at least one seventh entry field in said at least one first record having recorded therein said at least one first informational item in said at least one first table on said at least one page of said first form type;

forming at least one eighth column in said at least one second table wherein at least one eighth entry field is formed by the intersection of said at least one second row and said at least one eighth column; and recording said at least one first alphanumeric indicum in said at least one eighth entry field in said at least one first record having recorded therein said at least one first informational item in said at least one second table on said at least one first electronic-based media such that said at least one first informational item and said at least one first alphanumeric indicum can be used to link said at least one first informational item with said at least one second informational item on both the paper-based and electronic-based media.

15. A method of indexing and linking information as recited in claim 14 wherein said at least one second alphanumeric indicum uniquely identifies a location of said at least one fourth record in said at least one fourth table on said at least one electronic-based media to enable a programmer to readily determine said location of said at least one second informational item which is linked to said at least one first informational item whereby it may be made available to a person viewing said al least one first informational item.

16. A method of indexing and linking information as recited in claim 14, further comprising the steps of:

forming at least one ninth vertical column in said at least one first record in said at least one first table wherein at least one ninth entry field is formed by the intersection of said at least one first row and said at least one ninth column;

recording at least one second alphanumeric indicum in said at least one ninth entry field in said at least one first record in said at least one first table on said at least one page of said first form type such that recording said at least one first informational item in said at least one first record assigns said second alphanumeric indicum to said first informational item;

forming at least one tenth column in said at least one second record in said at least one second table on said at least one electronic-based media wherein at least one tenth entry field is formed by the intersection of said at least one second row and said at least one tenth column; and recording said at least one second alphanumeric indicum in said at least one tenth entry field in said at least one first record in said at least one first table on said at least one page of said first form type such that recording said at least one first informational item in said first at least one entry field in said at least one second record having recorded therein said at least one second alphanumeric indicum in said at least one first table on said at least one electronic-based media assigns said second alphanumeric indicum to said first informational item.

17. A method of indexing and linking information which comprises the steps of:

forming at least one page of a first form type;

assigning at least one first unique alphanumeric indicum to each of a plurality of said pages of said first form type;

recording said at least one first unique alphanumeric indicum on each of a plurality of said pages of said first form type;

forming at least one first table as a rectangular structure on said at least one page of said at least one first form type;

forming at least one first record as a horizontal row in said at least one first table;

forming at least one first vertical column in said at least one first table wherein at least one first entry field is formed by the intersection of said at least cone first row and said at least one first vertical column;

recording at least one second alphanumeric indicum in said at least one first entry field in said at least one first record in said at least one first table on said at least one page of at least one first form type;

forming at least one second vertical column in said at least one first table wherein at least one second entry field is formed by the intersection of said at least one first row and said at least one second vertical column;

recording at least one first informational item in said at least one second entry field in said at least one first record having said at least one second alphanumeric indicum recorded therein in said at least one first table on said at least one page of at least one first form type wherein said recording assigns said at least one second alphanumeric indicum to said at least one first informational item;

forming at least one second table on at least one first electronic-based media;

forming at least one second record as a row in said at least one second table;

forming at least one third column in said at least one second table wherein at least one third entry field is formed by the intersection of said at least one second row and said at least one third column;

recording said at least one first alphanumeric indicum item in said at least one third entry field in said at least one second record in said at least one second table on said at least one first electronic-based media;

forming at least one fourth column in said at least one second table wherein at least one fourth entry field is formed by the intersection of said at least one second row and said at least one fourth column;

recording said at least one second alphanumeric indicum in said at least one fourth entry field in said at least one second record having therein recorded said at least one first alphanumeric indicum in said at least one second table on said at least one first electronic-based media;

forming at least one fifth column in said at least one second table wherein at least one fifth entry field is formed by the intersection of said at least one second row and said at least one fifth column;

recording said at least one first informational item in said at least one fifth entry field in said at least one second record having therein recorded said at least one first alphanumeric indicum in said at least one second table on said at least one first electronic-based media;

forming at least one page of a second form type;

assigning at least one third unique alphanumeric indicum to each of a plurality of pages of said second form type;

recording said at least one third unique alphanumeric indicum on each of a plurality of said pages of said second form type;

forming at least one third table as a rectangular structure on said at least one page of said at least one second form type;

forming at least one third record as a horizontal row in said at least one third table;

forming at least one sixth vertical column in said at least one third table wherein at least one sixth entry field is formed by the intersection of said at least one third row and said at least one sixth vertical column;

recording at least one fourth alphanumeric indicum in said at least one sixth entry field in said at least one third record in said at least one third table on said at least one page of at least one second form type;

forming at least one seventh vertical column in said at least one third table wherein at least one seventh entry field is formed by the intersection of said at least one third row and said at least one seventh vertical column;

recording at least one second informational item in said at least one seventh entry field in said at least one third record having recorded therein said at least one fourth alphanumeric indicum in said at least one third table on said at least one page of at least one second form type wherein said recording assigns said at least one fourth alphanumeric indicum to said at least one second informational item;

forming at least one fourth table on said at least one of said first electronic-based media and at least one second electronic-based media;

forming at least one fourth record as a row in said at least one fourth table;

forming at least one eighth column in said at least one fourth table wherein at least one third entry field is formed by the intersection of said at least one fourth row and said at least one eighth column;

recording said at least one third alphanumeric indicum item in said at least one eighth entry field in said at least one fourth record in said at least one fourth table on said at least one second media;

forming at least one ninth column in said at least one fourth table wherein at least one ninth entry field is formed by the intersection of said at least one fourth row and said at least one ninth column;

recording said at least one fourth alphanumeric indicum in said at least one ninth entry field in said at least one fourth record having therein recorded said at least one third alphanumeric indicum in said at least one fourth table on said at least one second electronic-based media;

forming at least one tenth column in said at least one fourth table wherein at least one tenth entry field is formed by the intersection of said at least one fourth row and said at least one tenth column;

recording said at least one second informational item in said at least one tenth entry field in said at least one fourth record having therein recorded said at least one third alphanumeric indicum in said at least one second table on said at east one second electronic-based media;

forming at least one eleventh vertical column in said at least one first table wherein at least one eleventh entry field is formed by the intersection of said at least one first row and said at least one eleventh vertical column;

forming at least one twelfth vertical column in said at least one first table wherein at least one twelfth entry field is formed by the intersection of said at least one first row and said at least one twelfth vertical column;

recording said fourth alphanumeric indicum assigned to said at least one second informational item in said eleventh entry field and said third alphanumeric indicum assigned to said plurality of pages of said second form type in said twelfth entry field in said at least one first record having recorded therein said at least one first informational item in said at least one first table on said at least one page of said first form type;

forming at least one thirteenth column in said at least one second table wherein at least one thirteenth entry field is formed by the intersection of said at least one second row and said at least one thirteenth column;

forming at least one fourteenth column in said at least one second table wherein at least one fourteenth entry field is formed by the intersection of said at least one second row and said at least one fourteenth column; and recording said fourth alphanumeric indicum assigned to said at least one second informational item in said thirteenth entry field and said third alphanumeric indicum assigned to said plurality of pages of said second form type in said fourteenth entry field in said at least one second record having recorded therein said at least one first informational item in said at least one second table on said at least one first electronic-based media such that said at least one first informational item and said at least one third and fourth alphanumeric indicia can be used to link said at least one first informational item with said at least one second informational item.

18. The method of indexing and linking information as recited in claim 17, further comprising the steps of:

forming at least one first informational division;

assigning at least one fifth unique alphanumeric indicum to each of said at least one first informational division;

placing at least one page of said at least one first form type having recorded therein said at least one first informational item within said at least one first informational division;

recording said fifth unique alphanumeric indicum assigned to said at least one first informational division on each said at least one page of said first form type;

forming at least one fifteenth column in said at least one second table wherein at least one fifteenth entry field is formed by the intersection of said at least one second row and said at least one fifteenth column;

recording said at least one fifth alphanumeric indicum in said at least one fifteenth entry field in said at least one second record having therein recorded said at least one first alphanumeric indicum in said at least one second table on said at least one first electronic-based media;

forming at least one second informational division;

assigning at least one sixth unique alphanumeric indicum to said at least one second informational division;

placing at least one page of at least one second form type having recorded therein said at least one second informational item within said at least one second informational division;

recording said sixth unique alphanumeric indicum assigned to said at least one second informational division on each said at least one page of said second form type;

forming at least one sixteenth vertical column in said at least one first table wherein at least one sixteenth entry field is formed by the intersection of said at least one first row and said at least one sixteenth vertical column;

recording said fourth alphanumeric indicum assigned to said at least one second informational item in said eleventh entry field, said third alphanumeric indicum assigned to said plurality of pages of said second form type in said twelfth entry field, and said sixth alphanumeric indicum assigned to said at least one second informational division in said fifteenth entry field in said at least one first record having recorded therein said at least one first informational item in said at least one first table on said at least one page of said first form type;

forming at least one seventeenth column in said at least one second table wherein at least one seventeenth entry field is formed by the intersection of said at least one second row and said at least one seventeenth column; and recording said fourth alphanumeric indicum assigned to said at least one second informational item in said thirteenth entry field, said third alphanumeric indicum assigned to said plurality of pages of said second form type in said fourteenth entry field, and said sixth alphanumeric indicum assigned to said at least one second informational division in said seventeenth entry field in said at least one second record having recorded therein said at least one first informational item in said at least one second table on said at least one first electronic-based media such that said at least one first informational item and said at least one third, fourth and sixth alphanumeric indicia can be used to link said at least one first informational item with said at least one second informational item.

* * * * *